US007107810B2

(12) United States Patent
McClung

(10) Patent No.: US 7,107,810 B2
(45) **Date of Patent: *Sep. 19, 2006**

(54) METHOD AND APPARATUS FOR FORMING CONTAINER END SHELLS WITH REINFORCING RIB

(75) Inventor: James A. McClung, North Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 38 days.

This patent is subject to a terminal disclaimer.

(21) Appl. No.: 10/914,420

(22) Filed: Aug. 9, 2004

(65) Prior Publication Data

US 2005/0044921 A1 Mar. 3, 2005

Related U.S. Application Data

(63) Continuation-in-part of application No. 10/648,981, filed on Aug. 26, 2003, now Pat. No. 7,036,348.

(51) Int. Cl.
*B21D 51/44* (2006.01)

(52) U.S. Cl. ..... 72/348; 72/379.4; 72/336; 413/8; 413/56

(58) Field of Classification Search ..... 72/336, 72/348; 413/8, 56; 220/269, 254.1, 619
See application file for complete search history.

(56) References Cited

U.S. PATENT DOCUMENTS 3,186,583 A 6/1965 Zundel
3,525,455 A 8/1970 Saunders
3,696,961 A 10/1972 Holk, Jr.
3,705,563 A 12/1972 Elser
3,765,352 A 10/1973 Schubert et al.
3,848,557 A 11/1974 Holk, Jr.
3,853,080 A 12/1974 Zundel
3,868,919 A 3/1975 Schrecker et al.
3,871,314 A 3/1975 Stargell
3,939,787 A 2/1976 Morrison et al.
3,949,692 A 4/1976 DeLine et al.
3,990,376 A * 11/1976 Schubert et al. ..... 413/13
4,052,949 A * 10/1977 Woodley ..... 413/13
4,511,299 A 4/1985 Zysset
4,516,420 A 5/1985 Bulso, Jr. et al.
4,574,608 A 3/1986 Bulso, Jr. et al.

(Continued)

*Primary Examiner*—Dmitry Suhol
(74) *Attorney, Agent, or Firm*—David P. Maivald; Eckert Seamans Cherin & Mellott, LLC

(57) ABSTRACT

A method and apparatus for forming a rolled reinforcing rib in an end shell of a container body in a single stroke and at a single station of a single or double action press prior to removal of the shell from the press. A blank disc is cut from sheet material by a punch core advanced by an outer ram. A chuckwall is then formed between a central panel and an outer flange. The central panel is clamped against a die core and a portion of the chuckwall is clamped against a die core ring. An unclamped portion of the chuckwall is located in a void formed between the punch core and die core ring and is rolled into the reinforcing rib upon continued advancement of inner and outer pressure sleeve while maintaining a tight clamping engagement of the central panel and outer flange of the blank disc. Simultaneous removal of the clamping force applied by the punch core and inner and outer pressure sleeves retain the rib in its rolled condition.

22 Claims, 25 Drawing Sheets

U.S. PATENT DOCUMENTS

| | | | | |
|---|---|---|---|---|
| 4,587,825 | A | 5/1986 | Bulso, Jr. et al. | |
| 4,587,826 | A | 5/1986 | Bulso, Jr. et al. | |
| 4,713,958 | A | 12/1987 | Bulso, Jr. et al. | |
| 4,715,208 | A | 12/1987 | Bulso, Jr. et al. | |
| 4,716,755 | A | 1/1988 | Bulso, Jr. et al. | |
| 4,808,052 | A | 2/1989 | Bulso, Jr. et al. | |
| 5,020,955 | A | 6/1991 | Zumsteg | |
| 5,038,956 | A | 8/1991 | Saunders | |
| 5,881,593 | A * | 3/1999 | Bulso et al. | 72/336 |
| 5,970,775 | A | 10/1999 | McClung | |
| 6,014,883 | A | 1/2000 | McClung | |
| 6,425,721 | B1 | 7/2002 | Zysset | |
| 6,428,261 | B1 | 8/2002 | Zysset | |
| 6,539,767 | B1 * | 4/2003 | McClung | 72/336 |
| 6,658,911 | B1 * | 12/2003 | McClung | 72/336 |
| 6,685,417 | B1 | 2/2004 | Heinicke et al. | |
| 2002/0023474 | A1 * | 2/2002 | McClung | 72/348 |
| 2003/0034346 | A1 | 2/2003 | Turner et al. | |
| 2003/0042258 | A1 | 3/2003 | Turner et al. | |
| 2004/0065663 | A1 | 4/2004 | Turner et al. | |
| 2004/0200838 | A1 | 10/2004 | Turner et al. | |
| 2004/0211780 | A1 | 10/2004 | Turner et al. | |
| 2005/0006388 | A1 | 1/2005 | Turner et al. | |

* cited by examiner

METHOD AND APPARATUS FOR FORMING CONTAINER END SHELLS WITH REINFORCING RIB

CROSS REFERENCE TO RELATED APPLICATION

The present application is a continuation-in-part of patent application Ser. No. 10/648,981 filed Aug. 26, 2003 now U.S. Pat. No. 7,036,348.

BACKGROUND OF THE INVENTION

1. Technical Field

The invention relates to a method and apparatus for forming end shells for metal containers, and particularly to forming end shells having an annular reinforcing rib. Even more particularly, the invention relates to forming the reinforcing rib in the end shell in a single stroke and at a single station of a single or double action press.

2. Background Information

In the metal container art, containers usually consist of a body formed of lightweight metal, such as aluminum, and a separate end shell for closing the container, also formed of lightweight metal, from strip material. It is desirable in forming the end shell to form a reinforcing rib at the junction of the chuckwall with the central panel of the shell to provide strength and rigidity to the end shell when secured to the container body. Heretofore, these reinforcing ribs were formed as annular grooves in the end panel, examples of which are shown in U.S. Pat. Nos. 4,713,958, 4,715,208, 4,716,755, 4,808,052, 4,587,825, and 4,516,420. Although these types of reinforcing ribs have proven satisfactory, they provide an area in the can end which can collect impurities and other materials. This is especially undesirable when the container has a removable tab which enables the contents to be drank directly from the container.

Another type of reinforcing rib, referred to as a rolled rib or folded rib, has been developed to replace the annular groove reinforcing rib. Some examples of this rolled rib are shown in U.S. Pat. Nos. 6,425,721 and 6,428,261, and can be formed in an end shell having a score line for removal of the entire or a portion of the panel, or an end shell void of such a score line. This reinforcing rib is formed in the metal end shell by collapsing or rolling a portion of an unclamped portion of an end shell chuckwall back upon itself during the formation of the end shell in a single action press. Although this type of rolled or folded reinforcing rib has proven satisfactory, it involves multiple operations and in particular, requires forming the folded rib at a first station or in a first press, and then final forming it in a second station or second press due to the partial unrolling or unfolding of the rolled rib after it has been formed at a first station due to the tendency of the metal in an unclamped portion thereof to return to its pre-stamped position.

Thus, the need exists for an apparatus and method for forming container end shells having a folded or rolled annular reinforcing rib in a single press cycle and at a single station, without having to complete the forming of the rib at a subsequent station, by eliminating the tendency of the stamped end shell including the rolled rib, to return to its pre-stamped condition.

BRIEF SUMMARY OF THE INVENTION

The present invention provides an apparatus and method for forming an end shell for use on a container body which is formed in a single press cycle at a single work station of a single or double action press, wherein an unclamped portion of the chuckwall of the end shell, which extends between a central panel and peripheral flange, is folded or rolled upon itself to form a rolled reinforcing rib adjacent the junction of the central panel and chuckwall.

Another aspect of the present invention provides for the forming of an annular rolled reinforcing rib in the end shell without complicated and expensive modifications for retrofitting existing single or double action presses, and which eliminates the need for transfer mechanisms for the transferring of the end shell to an adjacent station or press for final formation of the reinforcing rib in the container end shell.

A further aspect of the invention provides an apparatus and method for forming the reinforcing rib in the end shell in which the punch core is fluidly mounted on an inner ram of the press, enabling the ram to continue in its cycle after the punch core has reached the bottom of its stroke for clamping the central panel of a disc blank against the die core, which enables the inner ram to time its return stroke to correspond to the start of the return stroke of the outer ram.

Another feature of the invention is providing inner and outer pressure sleeves which are movable by the outer ram for clamping engagement with an aligned inner die core ring, wherein said die core ring forms an annular void with the punch core in which the rolled reinforcing flange is formed during continued movement of the inner and outer pressure sleeves after the punch core has bottomed out against the die core.

Still another feature of the invention is to provide the inner pressure sleeve with a curved surface against which an unclamped portion of the chuckwall of the partially formed end shell is engaged for curling or rolling the unclamped metal upon itself to form the rolled reinforcing rib.

A further feature of the invention is to provide for the simultaneous un-clamping of the punch core and inner and outer pressure sleeves from the formed end shell by timing the cyclical movement of the inner and outer rams, to prevent distortion of the formed metal and in particular, prevent partial unrolling of the formed reinforcing rib.

Another feature of the invention is to provide a method and apparatus for forming a rolled reinforcing rib in an end shell in a single action press in a single stroke and at a single station by controlling the movement of the ram by a double actuated cylinder/piston assembly and, supporting inner and outer pressure sleeves with pressure actuated cylinders.

The foregoing advantages, construction, and operation of the present invention will become more readily apparent from the following description and accompanying drawings.

BRIEF DESCRIPTION OF THE DRAWINGS

A preferred embodiment of the invention, illustrative of the best mode in which applicant contemplates applying the principles, is set forth in the following description and is shown in the drawings and is particularly and distinctly pointed out and set forth in the appended claims.

Similar numerals refer to similar parts throughout the drawings.

DETAILED DESCRIPTION OF THE INVENTION

Figure 1:
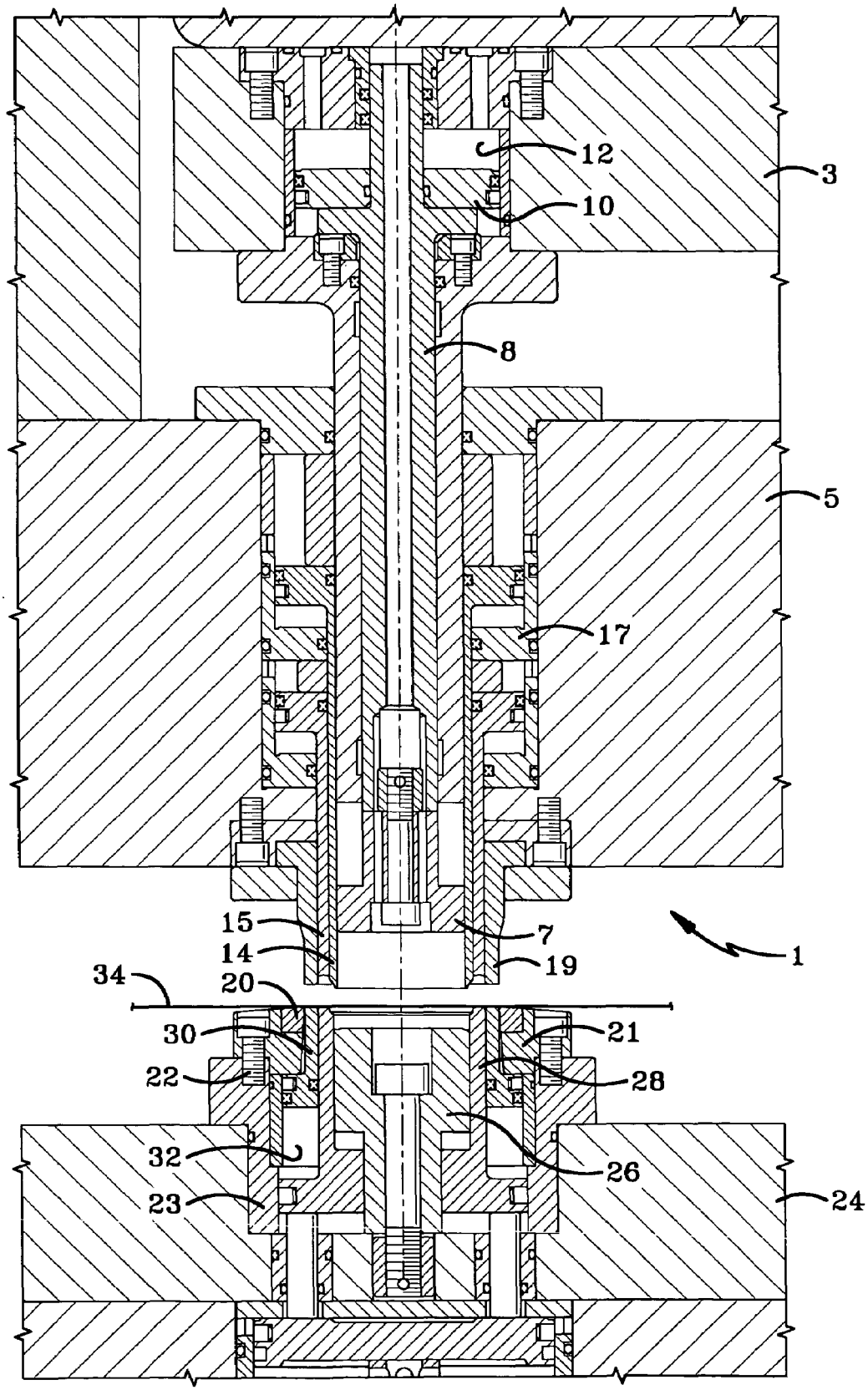
FIG. 1 is a partially schematic sectional view of the apparatus of the present invention mounted in a press showing the position of the sheet metal at the start of the forming operation.

The method and apparatus of the present invention is utilized in conjunction with single or double action presses, some examples of which are shown and described in U.S. Pat. Nos. 3,902,348, 5,626,048, and 5,628,224. The main features of a first embodiment of the press, which is indicated generally at 1 and shown in FIG. 1, are described briefly below, and include an inner ram 3 and an outer ram 5, only portions of which are shown in FIG. 1.

A punch core 7, also referred to as draw horn, is connected to the lower end of a punch riser 8, which is reciprocated by inner ram 3. In accordance with one of the features of the invention as shown in FIG. 1, riser 8 and punch core 7 are engaged with a fluid actuated piston 10, which is moved into engagement with punch riser 8 by compressed fluid located within a cylinder 12 formed within inner ram 3. The purpose of this arrangement is discussed further below.

An inner pressure sleeve 14 and a concentrically located outer pressure sleeve 15 surround punch core 7 and are reciprocated by outer ram 5 and independently move by a plurality of stacked cylinders 17. An outer punch shell 19 surrounds inner and outer pressure sleeves 14 and 15 and is secured to and movable with outer ram 5. A cut ring 20 is mounted on a retaining sleeve 21, which in turn is secured by a plurality of bolts 22 to a pedestal 23 mounted in a base 24.

A die core 26 is fixedly mounted with respect to base 24, and is surrounded by a movable die core ring 28, which is fluidly supported with respect to base 24. A lower pressure sleeve 30 is concentrically located outboard of die core ring 28, and is fluidly supported within a pressure cylinder 32 with respect to base 24.

The particular arrangement and features of the various elements of double action press 1 set forth above are standard components in the container end shell forming art, and thus, do not require extensive modification except for several unique features discussed further below.

Figure 2:
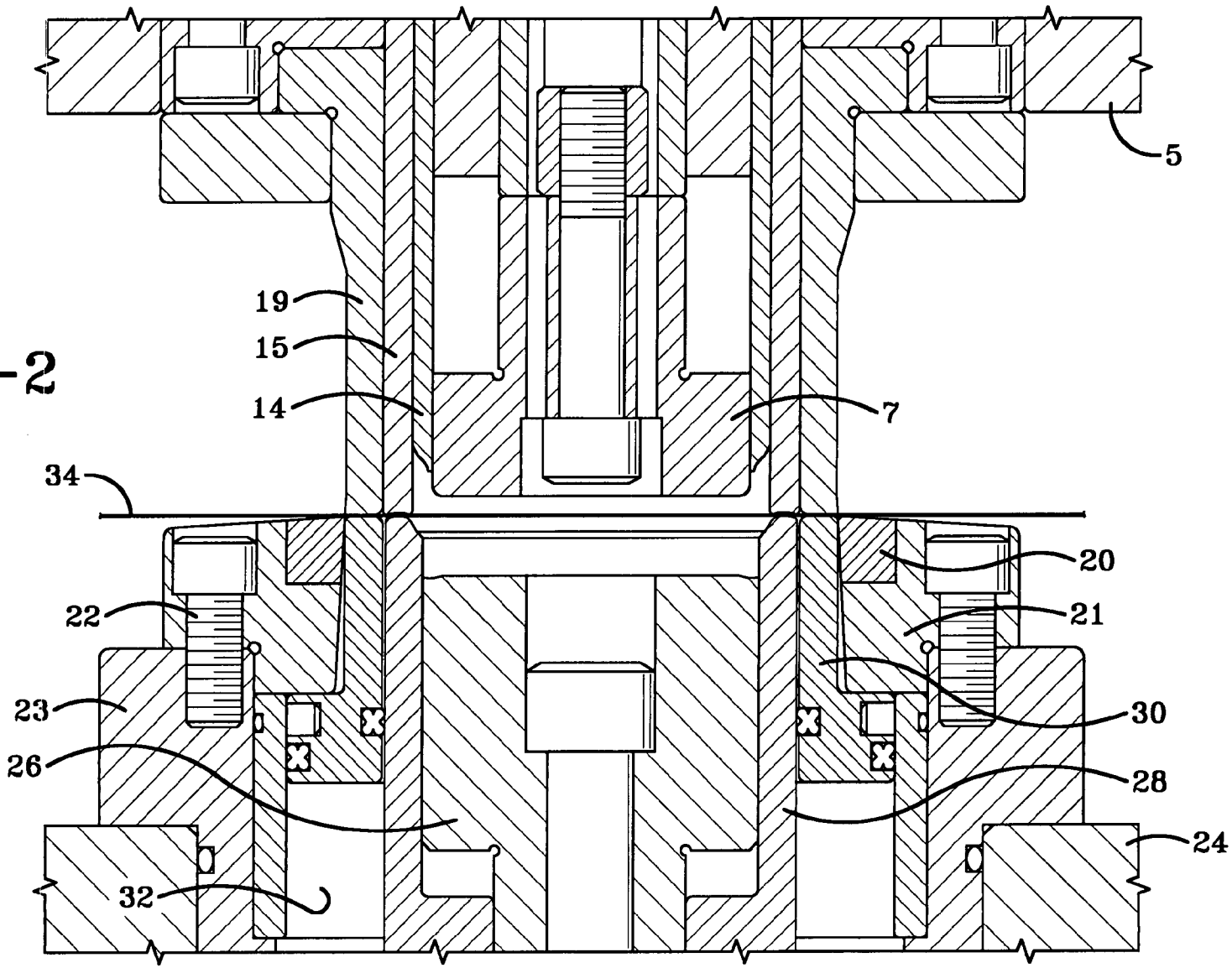
FIG. 2 is an enlarged view showing the position of the apparatus at the start of the forming operation.
Figure 3:
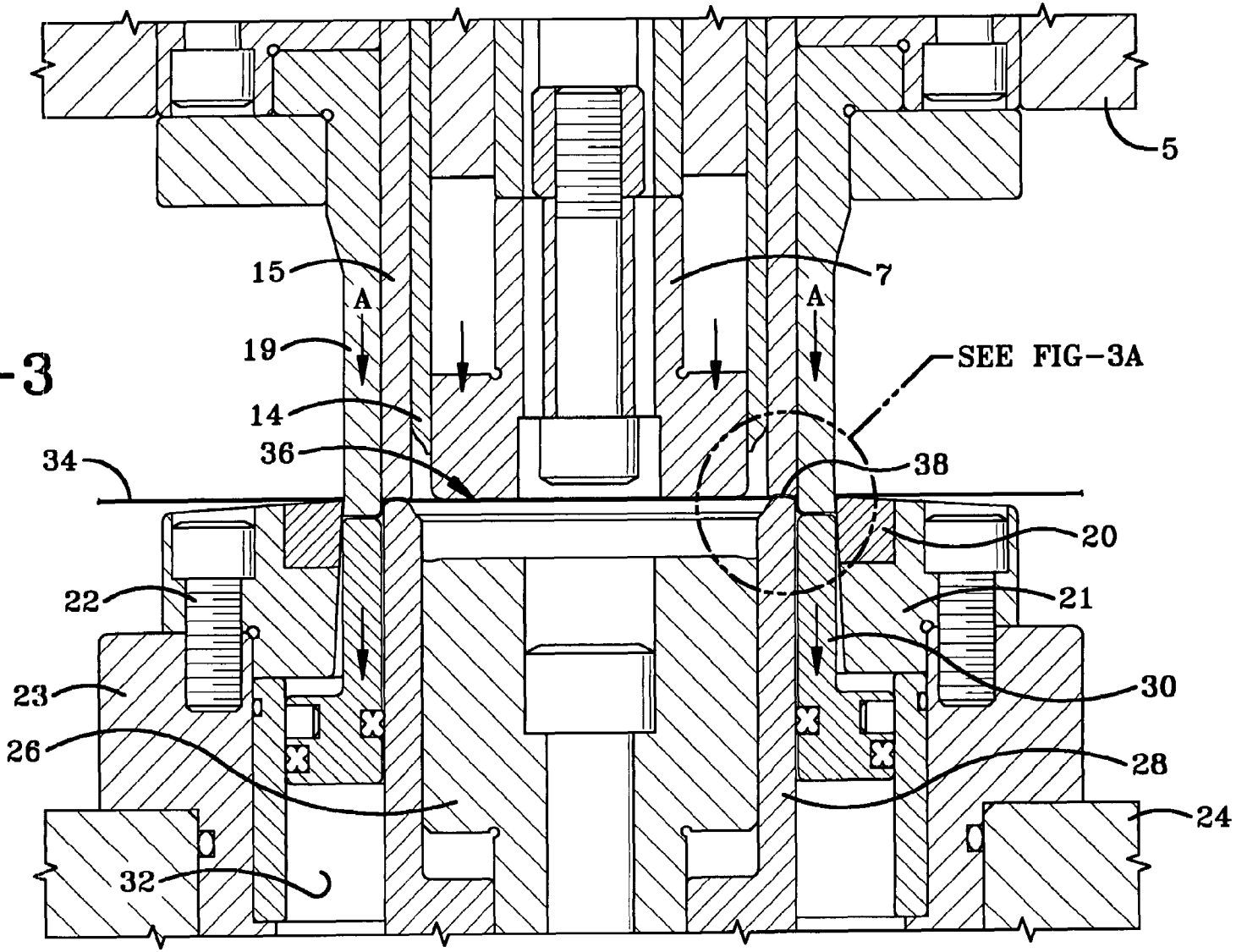
FIG. 3 is an enlarged fragmentary sectional view similar to FIG. 1 showing the blanking of a disc blank from the sheet material at the start of the forming operation.

In further accordance with the invention, a timing mechanism represented by the timing diagram of FIG. 7, controls the reciprocal movement or strokes of inner and outer rams 3 and 5 in a manner well known in the press art, and thus, is not described in detail except for the unique features of the timing cycle discussed further below achieved by the timing control system. In carrying out the method steps of the present invention, a strip of sheet material 34, such as lightweight aluminum, is fed into the press, as shown in FIGS. 1 and 2. Outer ram 5 moves punch shell 19 downwardly in the direction of arrow A (FIG. 3) to sever a flat blank disc 36 from the sheet material without requiring any prior clamping pressure being applied to the sheet material. Blank 36 then is releasably clamped between outer pressure sleeve 15 and top surface 38 of die core ring 28 by the downward movement of outer ram 5.

Figure 3A:
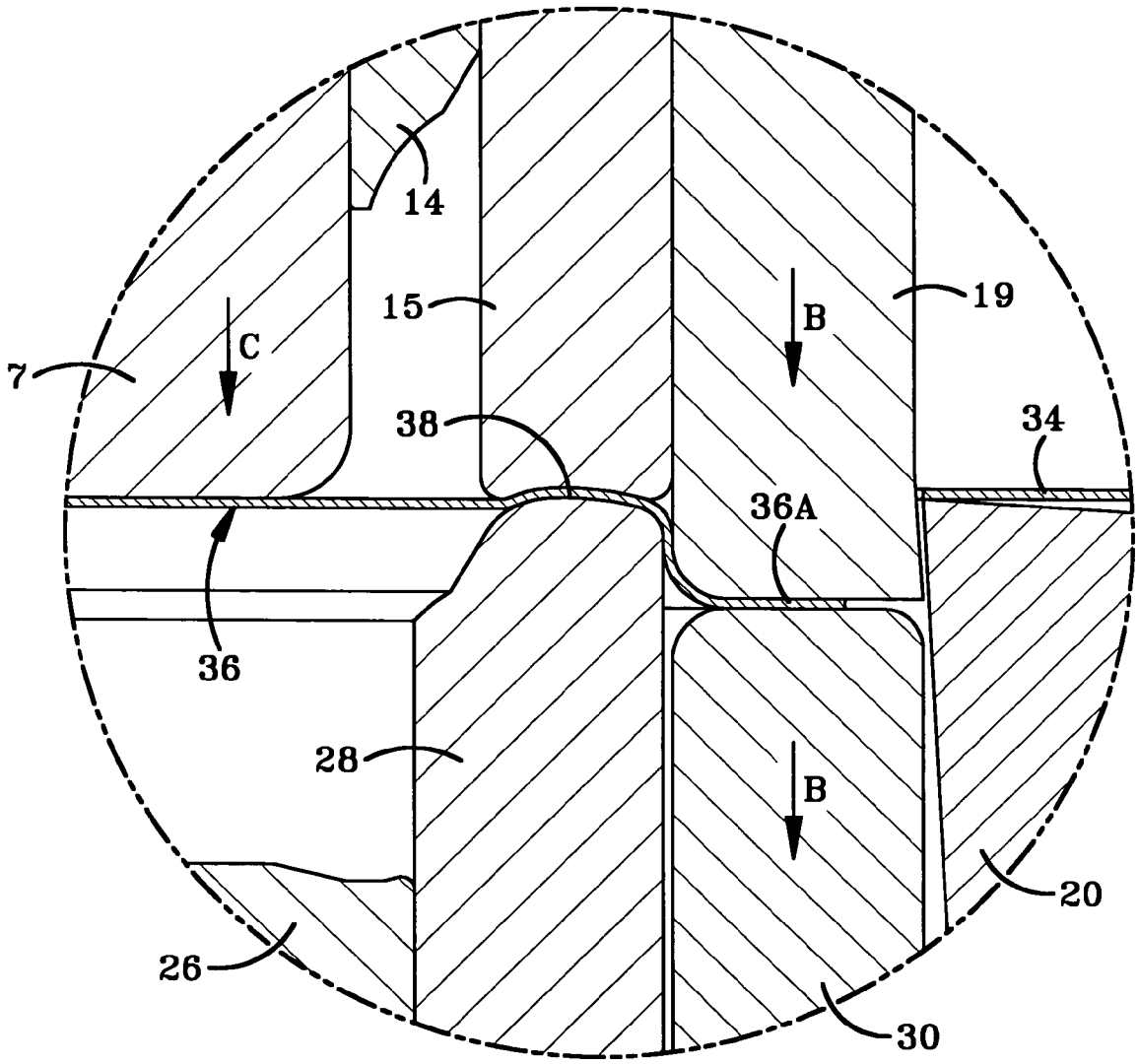
FIG. 3A is a further enlarged fragmentary sectional view of the encircled portion of FIG. 3.
Figure 3B:
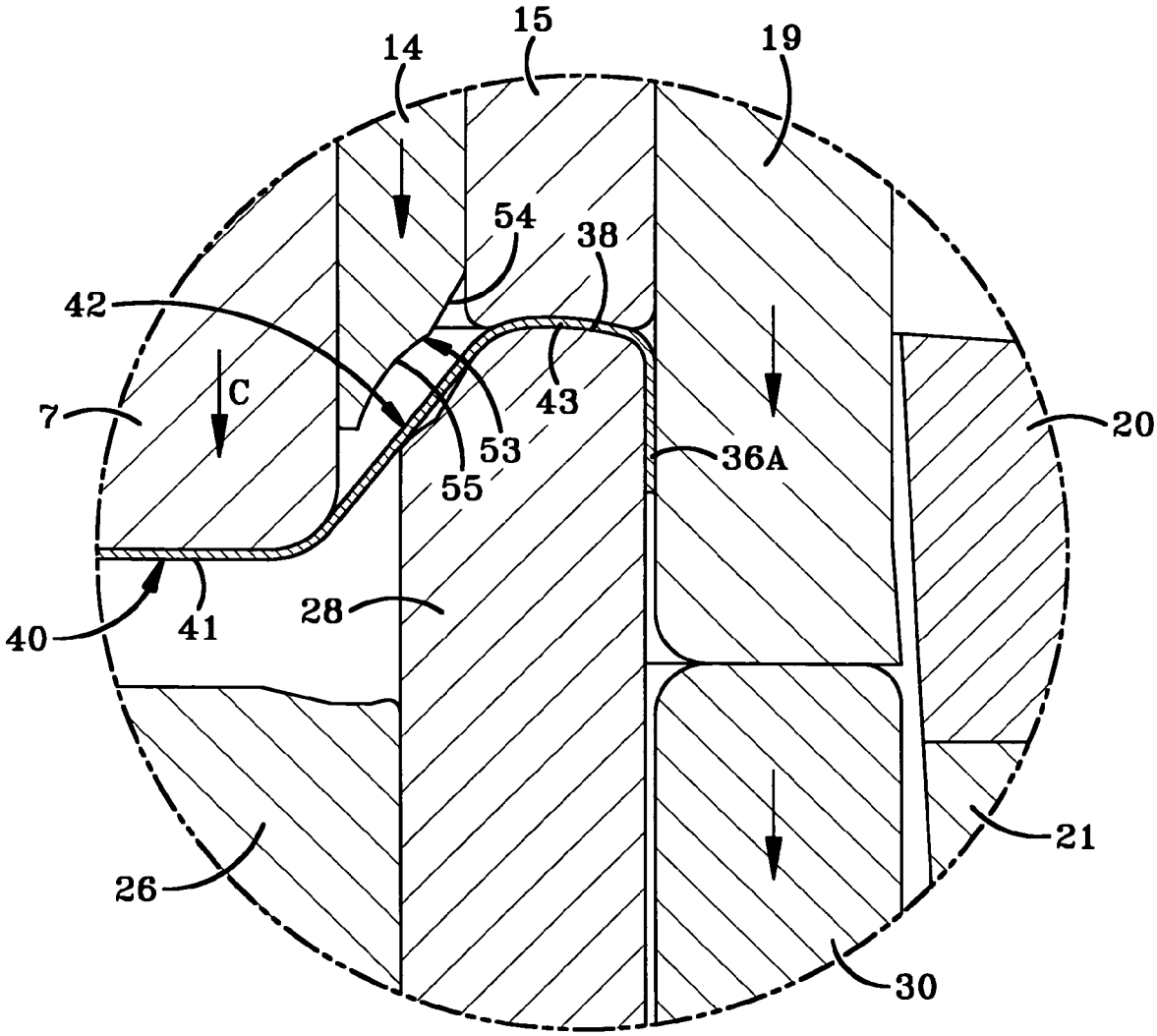
FIG. 3B is a view similar to FIG. 3A showing the start of forming a chuckwall of an end shell blank.
Figure 4:
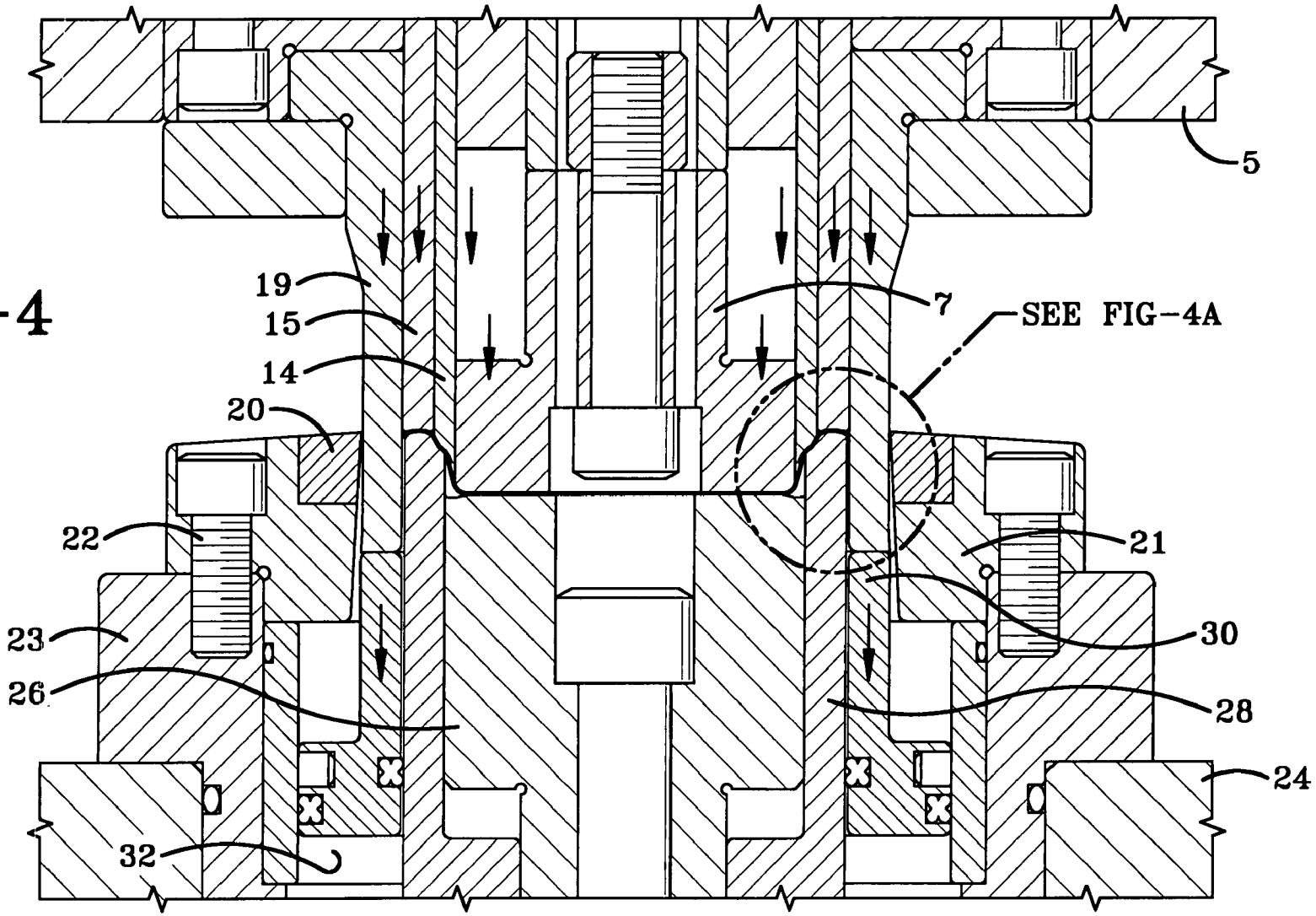
FIG. 4 is a sectional view showing the continued movement of the punch core and inner pressure sleeve from the position of FIG. 3 into clamping engagement with the end shell.
Figure 4A:
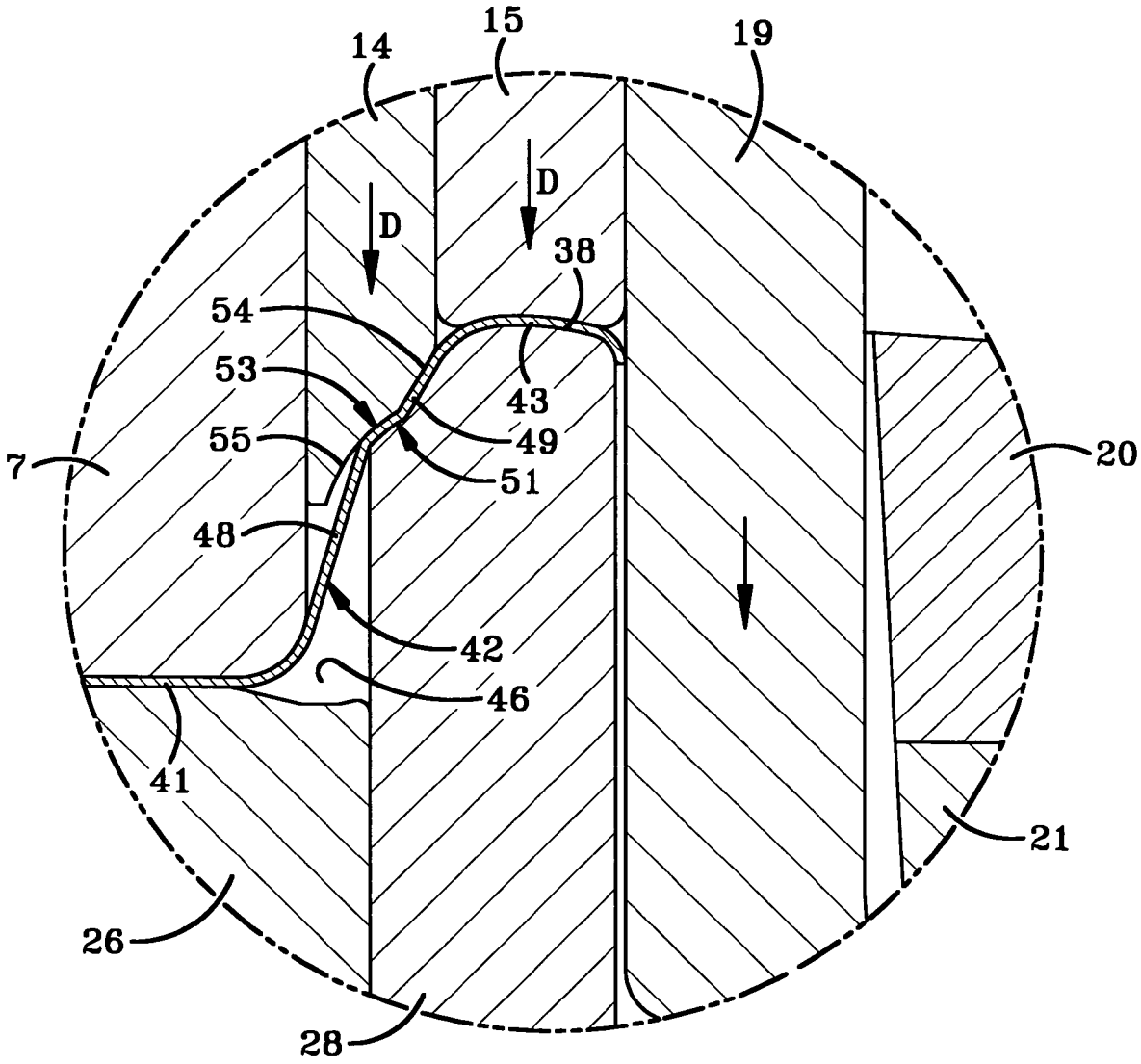
FIG. 4A is a further enlarged fragmentary sectional view of the encircled portion of FIG. 4.

As punch shell 19 and lower pressure sleeve 30 continue to be moved downwardly by outer ram 5 from the position of FIG. 3A to that of 3B in the direction of arrows B, an outer portion 36A of blank disc 36 is releasably clamped therebetween and will subsequently be removed therefrom, as shown in FIG. 3B. Downward movement of inner ram 3 which leads the movement of outer ram 5 preferably by about 25°, will move punch core 7 in a downward direction shown by Arrow C in FIGS. 3A and 3B. As punch core 7 moves toward die core 26, the metal in outer portion 36A of the disc blank, which is releasably clamped between outer pressure sleeve 15 and die core ring 28, moves therebetween to form a partially formed end shell 40. Shell 40 has a central panel 41, a chuckwall 42, and an outer flange 43. Inner ram 3 continues to advance punch core 7 toward base 24 by the use of the high pressure air in cylinder 12 as shown in FIG. 1, until it clamps central panel 41 against die core 26, as shown in FIG. 4A. In this position, outer flange 43 is clamped between outer pressure sleeve 15 and complementary shaped top surface 38 of die core ring 28.

Figure 3C:
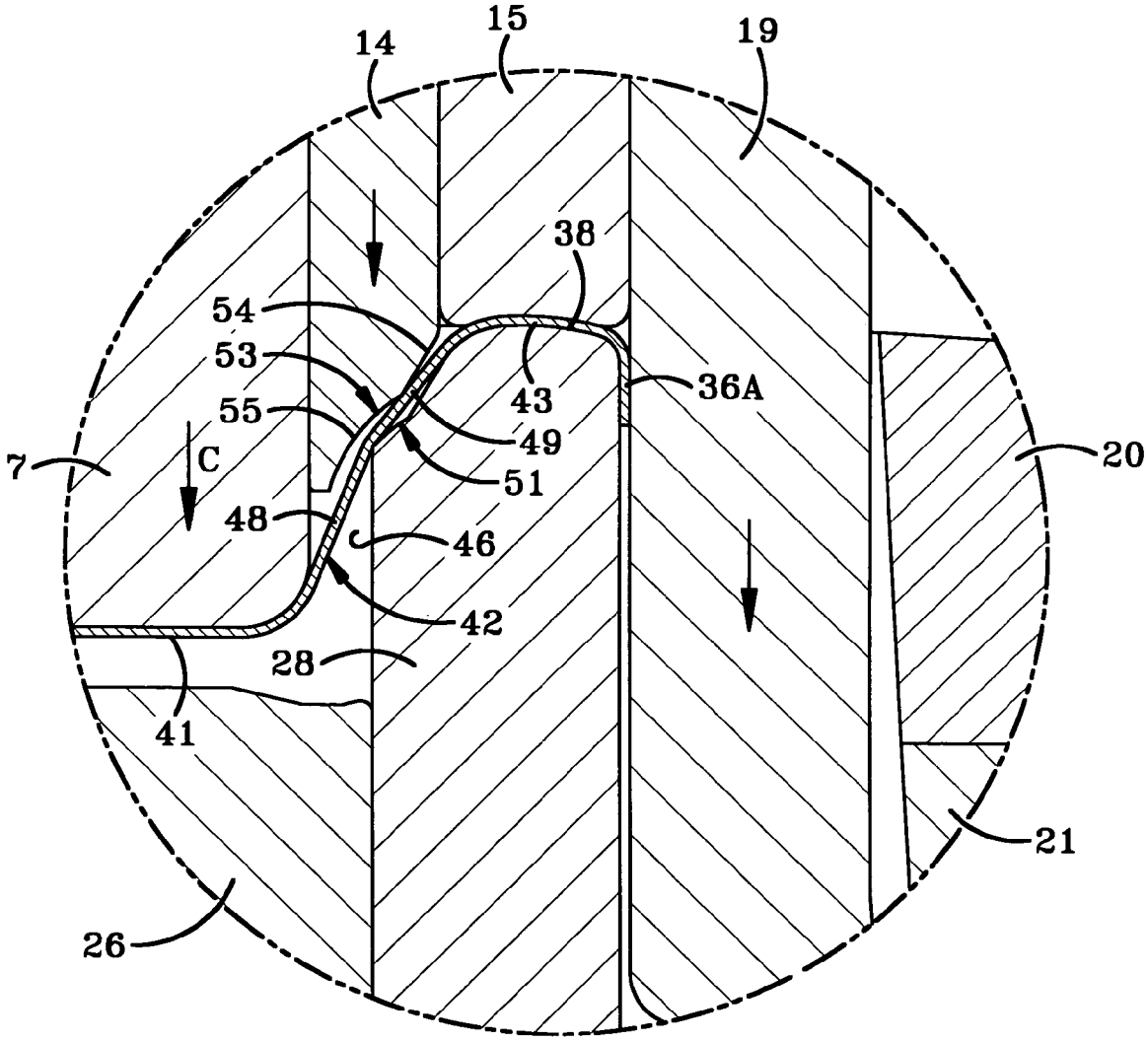
FIG. 3C is a view similar to FIGS. 3A and 3B showing the continued formation of the chuckwall of the end shell blank.

As shown in FIGS. 3C and 4A, an annular void or space 46 is formed between punch core 7 and die core ring 28, in which is located an unclamped portion 48 of chuckwall 42. As outer ram 5 continues downwardly, inner pressure sleeve 14 (FIG. 3A) will clampingly engage a chuckwall portion 49 against an angled surface 51 of the upper end of die core ring 28 adjacent the smooth generally curved surface 38 thereof (FIG. 4A). The lower end of inner pressure sleeve 14 (FIG. 3C) has a contoured surface indicated generally at 53, having an angled portion 54 and a concavely curved portion 55. Punch core 7 will bottom out and clamp central panel 41 of shell 40 against the top surface of die core 26 (FIG. 4A) and inner and outer pressure sleeves 14 and 15 continue to advance as shown by arrows D.

Figure 4B:
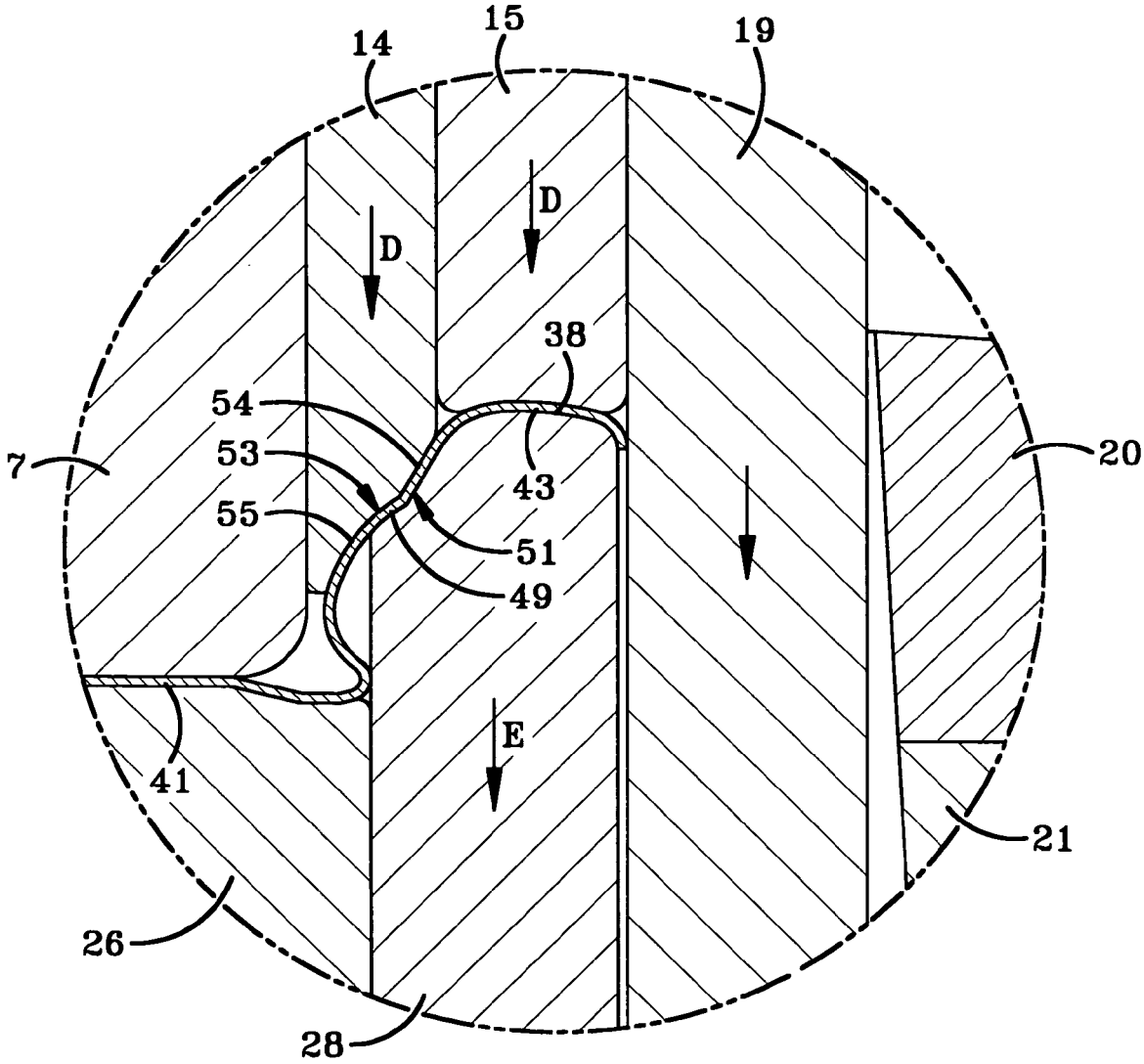
FIG. 4B is a view similar to FIG. 4A showing the continued movement of the inner and outer pressure sleeves to start the folding of the un-clamped chuckwall portion into the reinforcing rib.
Figure 5:
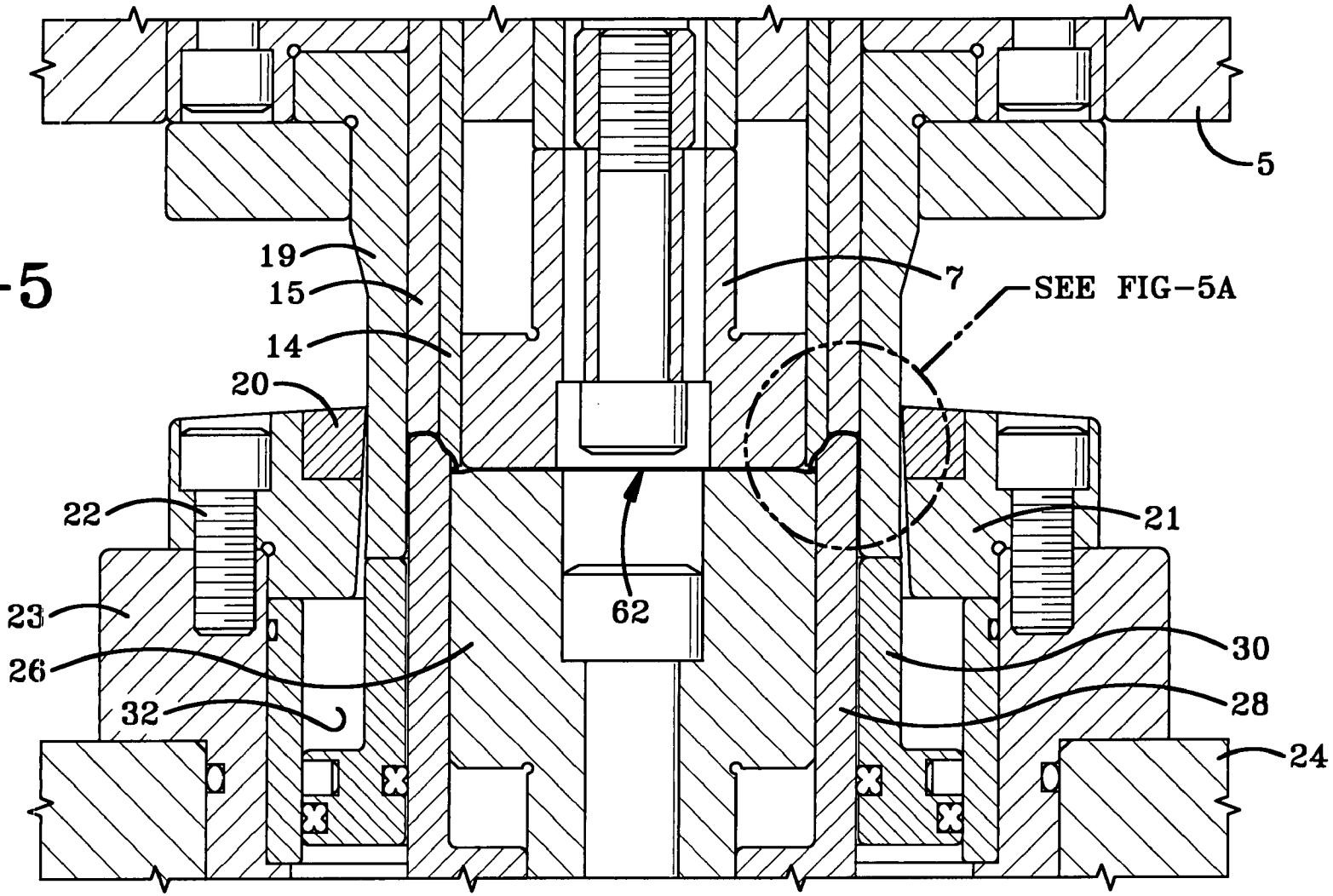
FIG. 5 is a view similar to FIGS. 3 and 4 showing the punch core, and inner and outer rams at the end of their stroke completing formation of the reinforcing rib.
Figure 5A:
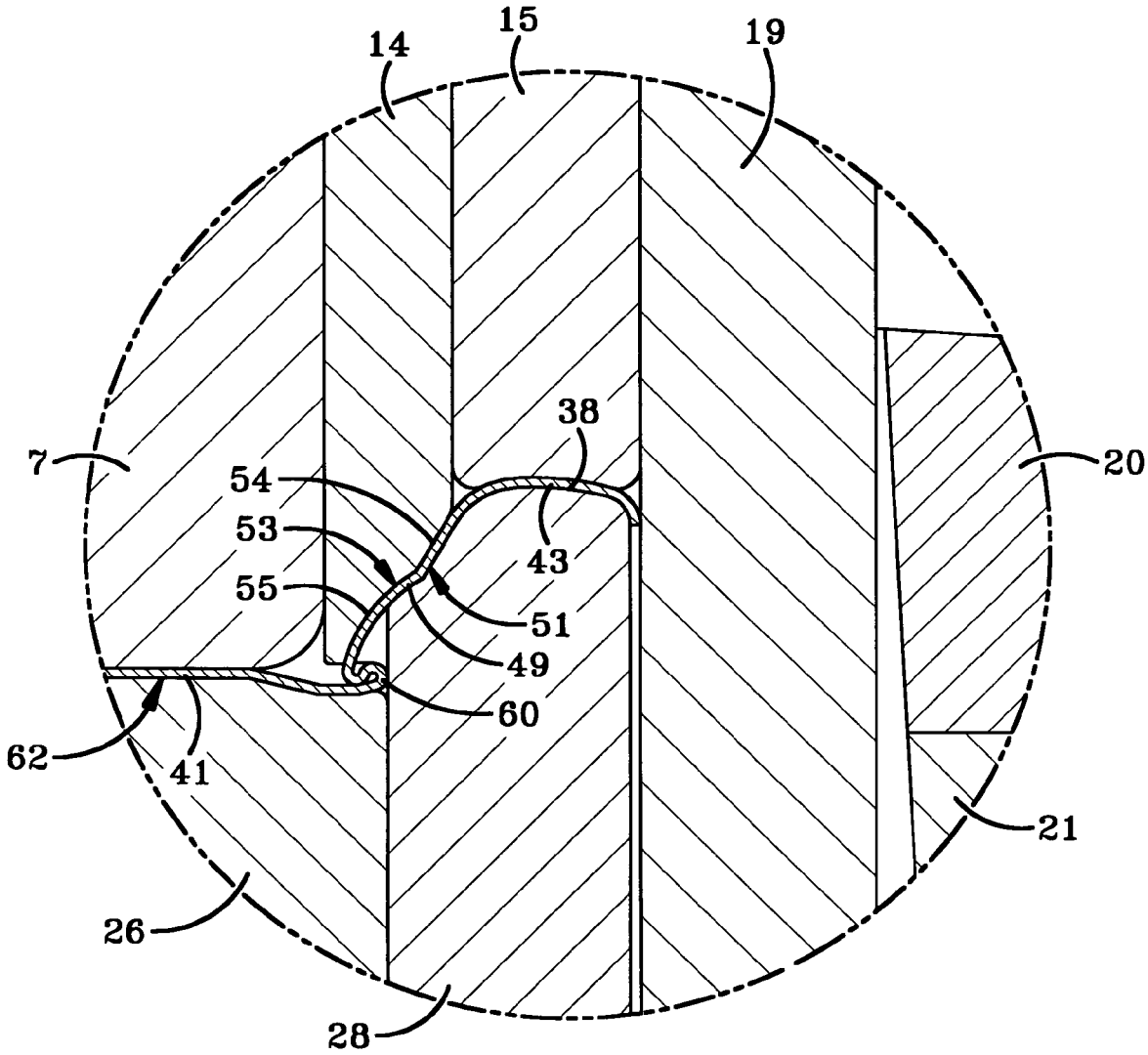
FIG. 5A is an enlarged fragmentary sectional view of the encircled portion of FIG. 5 showing the apparatus and end shell at the completion of the forming step.

Referring to FIG. 4B the continued downward movement of outer ram, and in particular, inner and outer pressure sleeves 14 and 15 in the direction of arrows D, moving with it the fluidly supported die core ring 28, as shown by arrow E, will cause the unclamped portion 48 of chuckwall 42, which is located in annular space 46, to move against concave surface portion 55 of inner pressure sleeve 14, causing the metal to start folding upon itself until it is completely rolled or folded on itself to form a reinforced rolled rib 60, as shown in FIG. 5A, upon pressure sleeves 14 and 15 reaching bottom-dead-center, as shown therein. During this movement, panel 41 is clamped tightly against die core 26 and portion 49 of chuckwall 42 is clamped tightly between inner pressure sleeve 14 and surface 51 of die core ring 28.

Figure 5B:
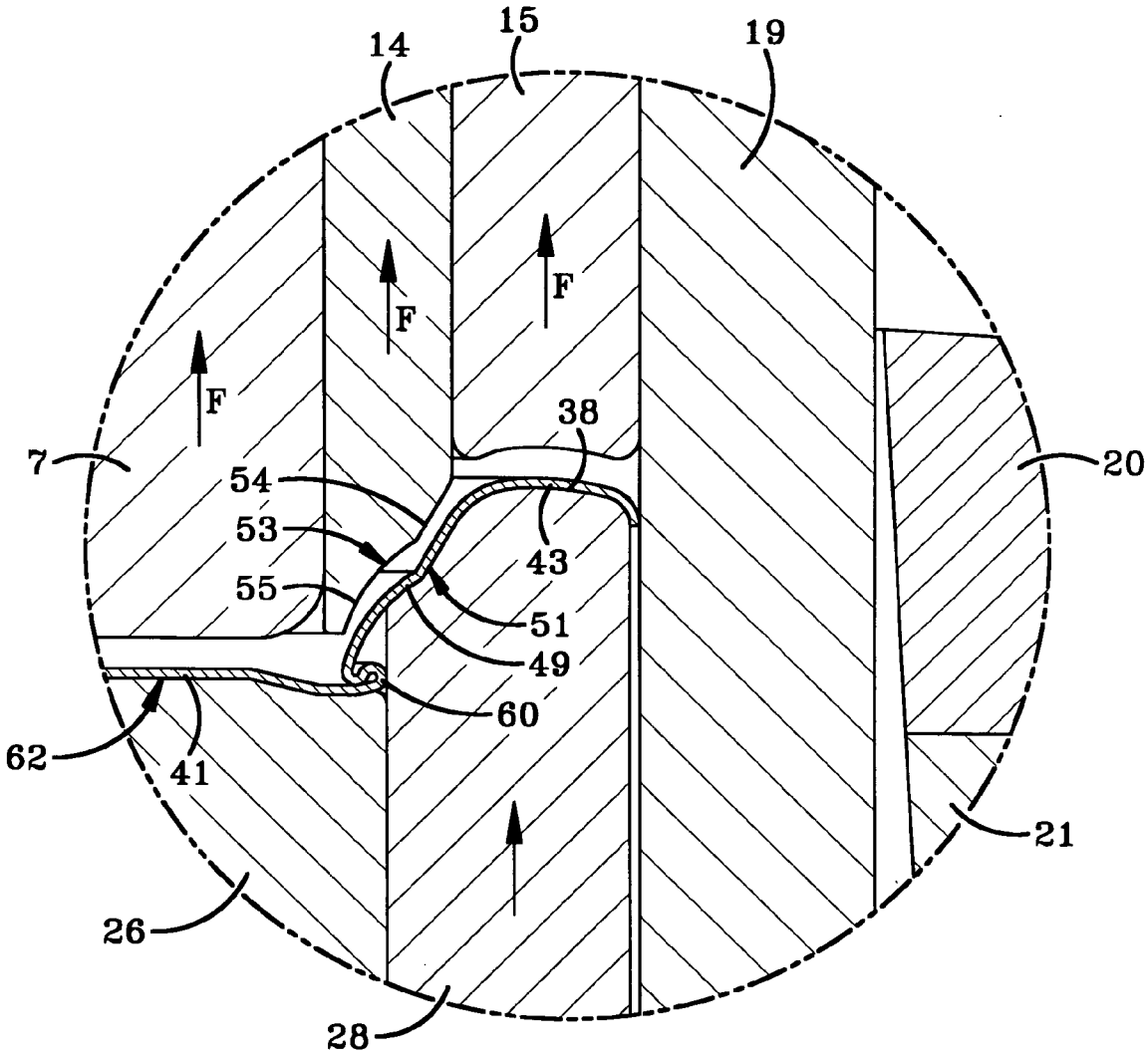
FIG. 5B is a view similar to FIG. 5A showing the simultaneous disengagement of the punch core and inner and outer pressure sleeves from the formed container end shell.

In accordance with one of the main features of the invention, the timing cycle of the inner and outer rams is controlled so that punch core 7; and inner and outer sleeves 14 and 15, retract or move away from their clampingly engaged position with die core 26 and die core ring 28 substantially simultaneously, as shown by arrows F in FIG. 5B. This prevents unequal metal distortion from being exerted on the formed end shell which is indicated generally at 62, and in particular on rib 60, which occurred in prior shell forming methods in which a rolled reinforcing rib was formed. Heretofore, in single action presses, the pressure sleeve would lift off before punch core 7, or visa versa, resulting in a partial unfolding of the rolled rib, which required the shell to be moved to a second station, either in the same press or in a different press, for final setting or formation of the rolled rib.

Figure 6:
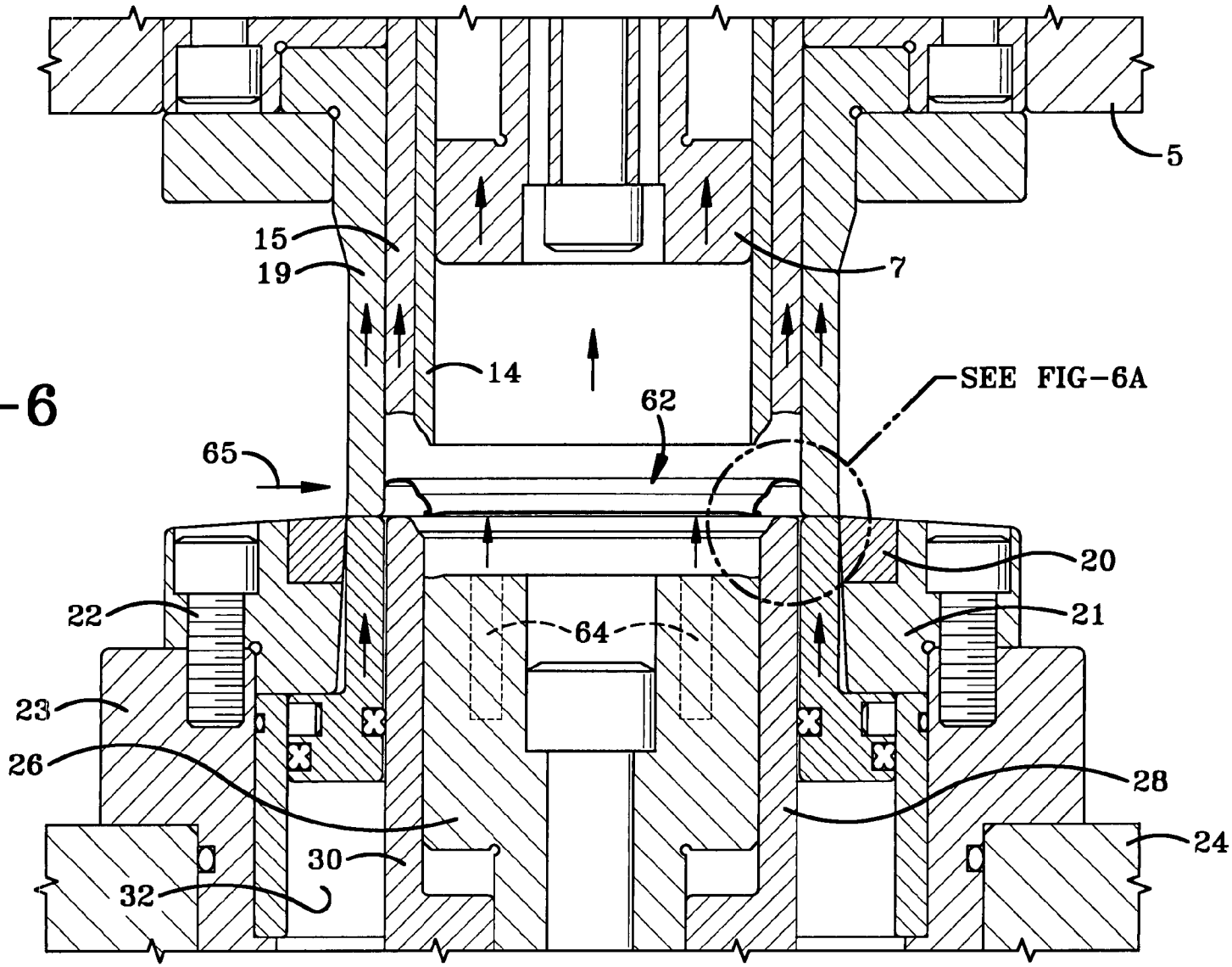
FIG. 6 is a view similar to FIGS. 3, 4, and 5 showing movement of the inner and outer rams and the position of the finished end shell prior to removal from the press.
Figure 6A:
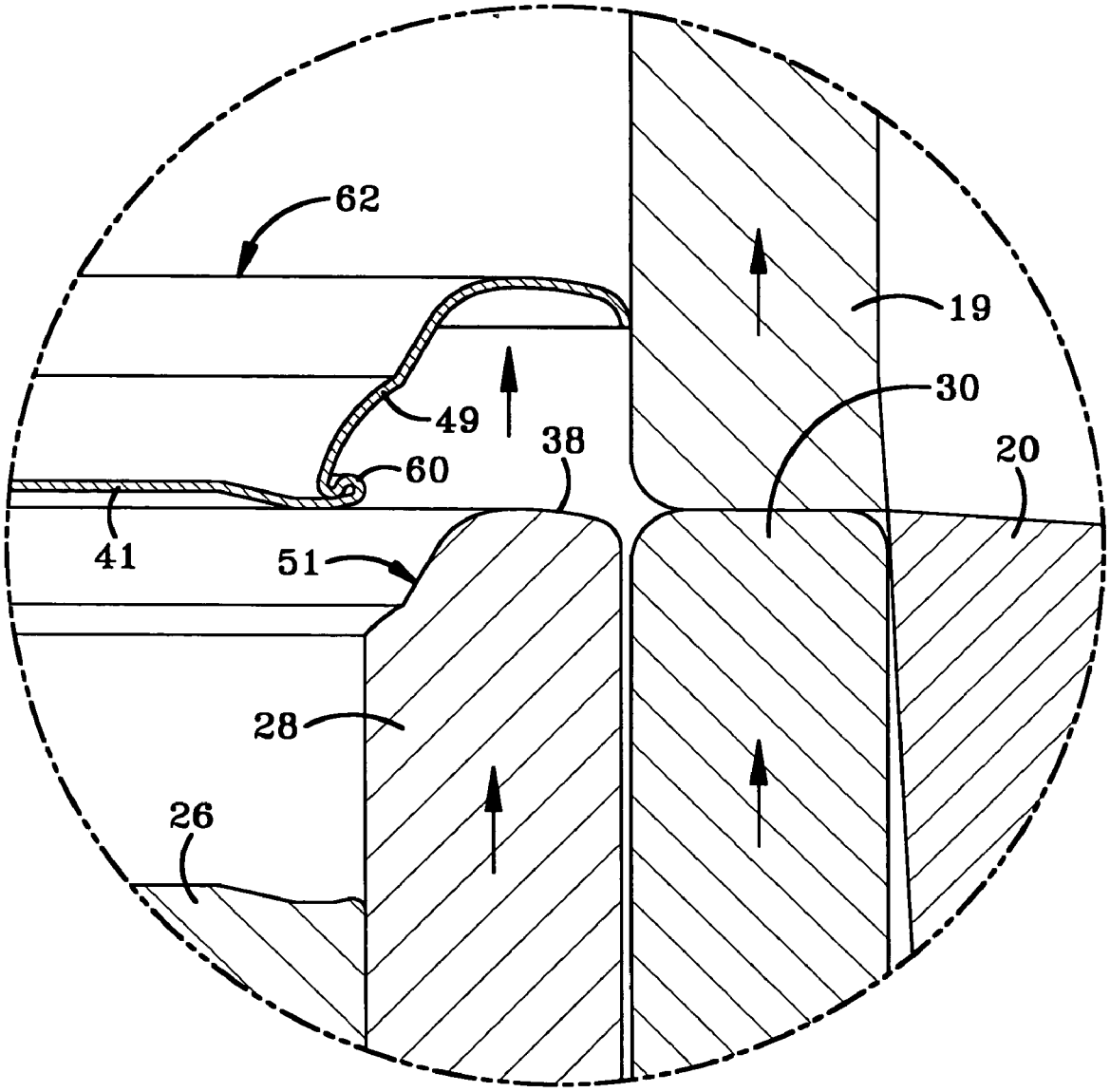
FIG. 6A is an enlarged fragmentary sectional view of the encircled portion of FIG. 6.
Figure 8:
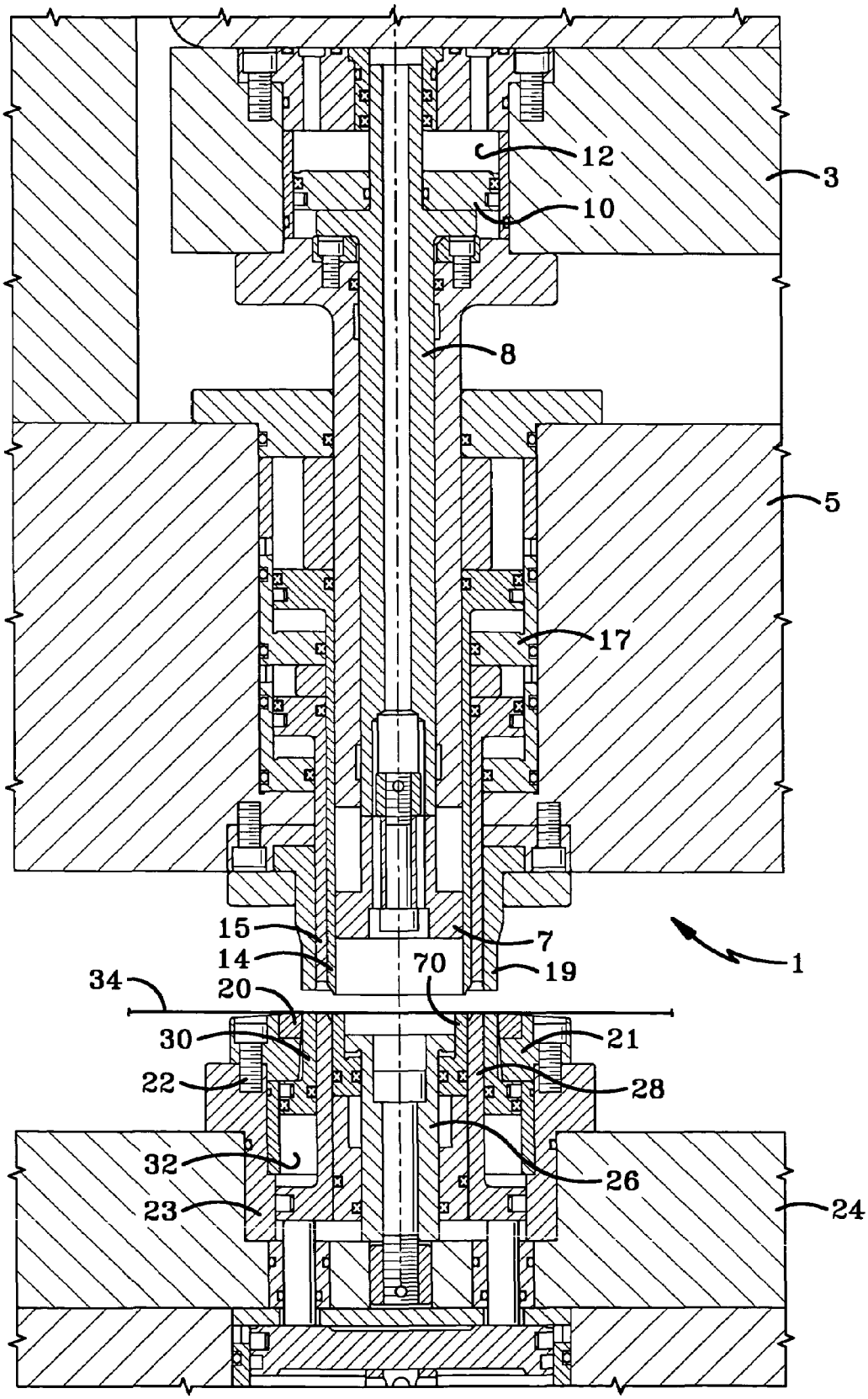
FIG. 8 is a fragmentary sectional view similar to FIG. 1 showing a knockout ring to assist in ejecting the end shell from the press.

However, it has been found that in accordance with the invention, the simultaneous removal of nearly all clamping pressure during lift off, as shown in FIG. 5B, prevents partial unrolling of the just formed reinforcing rib 60 since even though the metal attempts to return to an unformed state, it moves equally in all directions since it is unrestrained by any clamping action thereon. If desired, punch core 7 could retract slightly before pressure sleeves 14 and 15 without substantially effecting the final set or formation of rib 60. After release and retraction of punch core 7 and inner and outer pressure sleeves 14 and 15, shell 62 is released from the press by a blast of pressurized air though passages 64 formed in base 24 (FIG. 6), or other lift mechanism, such as an annular lift or knockout ring 70 as shown in FIG. 8, to the position of FIG. 6A, where it then can be ejected from the press by a jet of pressurized air 65, or other known ejection mechanism or device.

Figure 7:
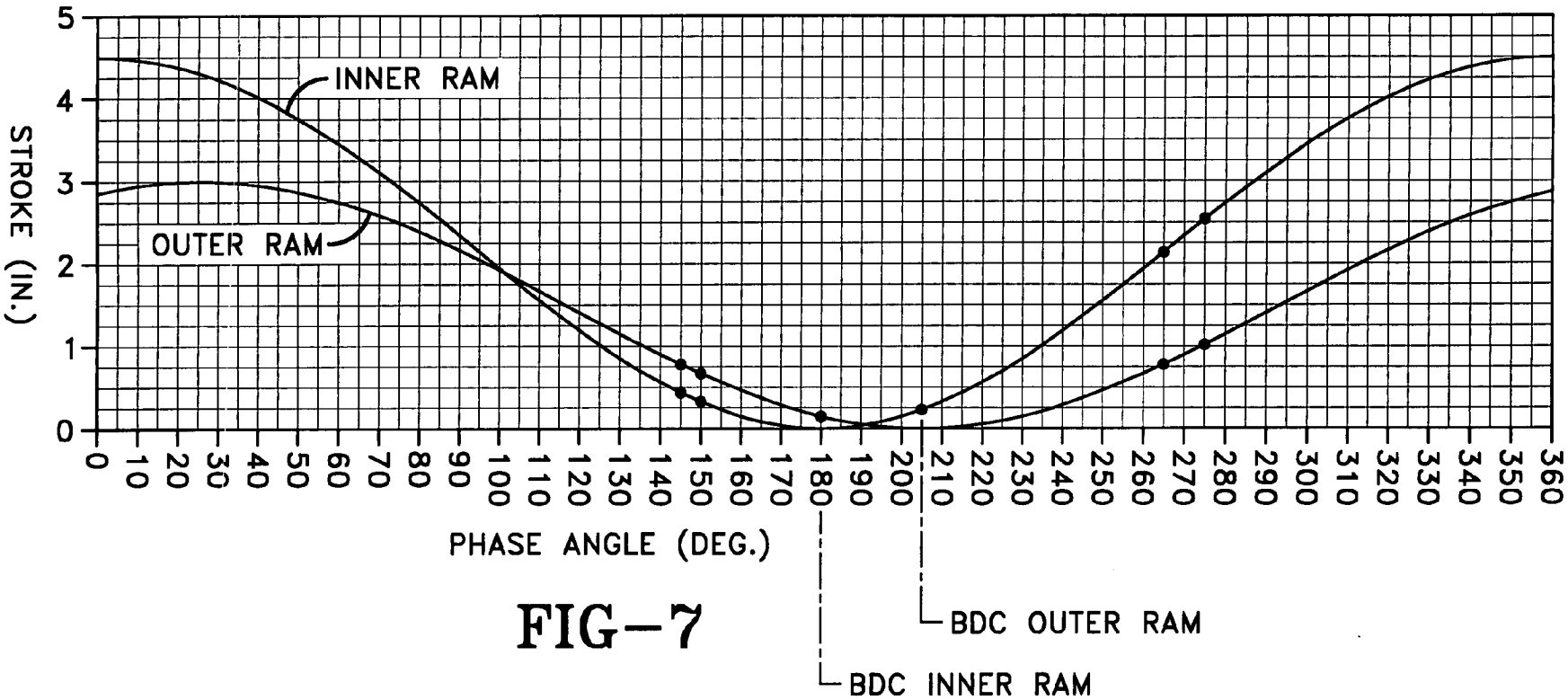
FIG. 7 is a timing diagram of the inner and outer rams of the press.

In accordance with one of the features of the invention, and as represented in FIG. 7, is the timing sequence of the inner and outer rams. The inner ram leads the outer ram approximately 25° so that the inner ram clamps the central panel against the die core, as shown in FIG. 4A, as it reaches bottom-dead-center (BDC), whereupon the outer ram continues to move pressure sleeves 14 and 15 in a downward direction to form rolled rib 60 in the annular space 46, as shown in FIG. 4B. This leading movement of inner ram 3 is able to be achieved by the use of piston 10 and fluid cylinder 12, as shown in FIG. 1. This arrangement enables the punch core 7 to be moved initially along with inner ram 3, but upon punch core 7 reaching bottom-dead-center as shown in FIG. 4, this fluid pressure arrangement provides for a dwell time of approximately 25° movement of the outer ram since inner ram 3 will continue its downward movement. However, punch core 7 remains stationary, with piston 10 moving upwardly through cylinder 12. This travel of piston 10 within cylinder 12 enables the inner ram to continue to move, but without affecting the clamping engagement of central panel 41 against die core 26. Therefore, as the outer ram reaches its bottom-dead-center, for example, 205° as shown in FIG. 7, inner ram 3 will still be at its bottom-dead-center, whereupon both the inner and outer rams will move upwardly at approximately the same instant of time to simultaneously remove the clamping engagement with the newly formed end shell, as shown In FIG. 5B, avoiding the partial unrolling of reinforcing rib 60. In the prior art formation of a rolled reinforcing rib in a single stage press, one of the pressure members will retract before the die core or visa versa resulting in one part of the shell remaining clamped, while the clamping pressure on another portion is relieved resulting in the partial unfolding of the rolled reinforcing rib.

The particular timing mechanism used for such double action presses is standard, and is easily calibrated to provide for any desired sequence of movement of the inner and outer rams, and thus, is not described in detail since the same is well known in the press art.

It furthermore understood from the above discussion that no thinning of the metal is required, but only the drawing and movement of the metal around the die core ring and a portion of the unclamped chuckwall back upon itself to form the final end shell with the rolled reinforcement rib.

A modified form of the apparatus of the present invention and method of carrying out the unique steps thereof is shown in FIGS. 9–17, wherein a single action press indicated generally at 100, is used for forming the reinforcing rolled rib 60, as described further below. Many of the components of press 100 are similar to those discussed above with respect to press 1, except that it is a single action press which uses a single ram indicated generally at 102. The manner of operation of the single action press 100 and the components thereof are described below.

Figure 9:
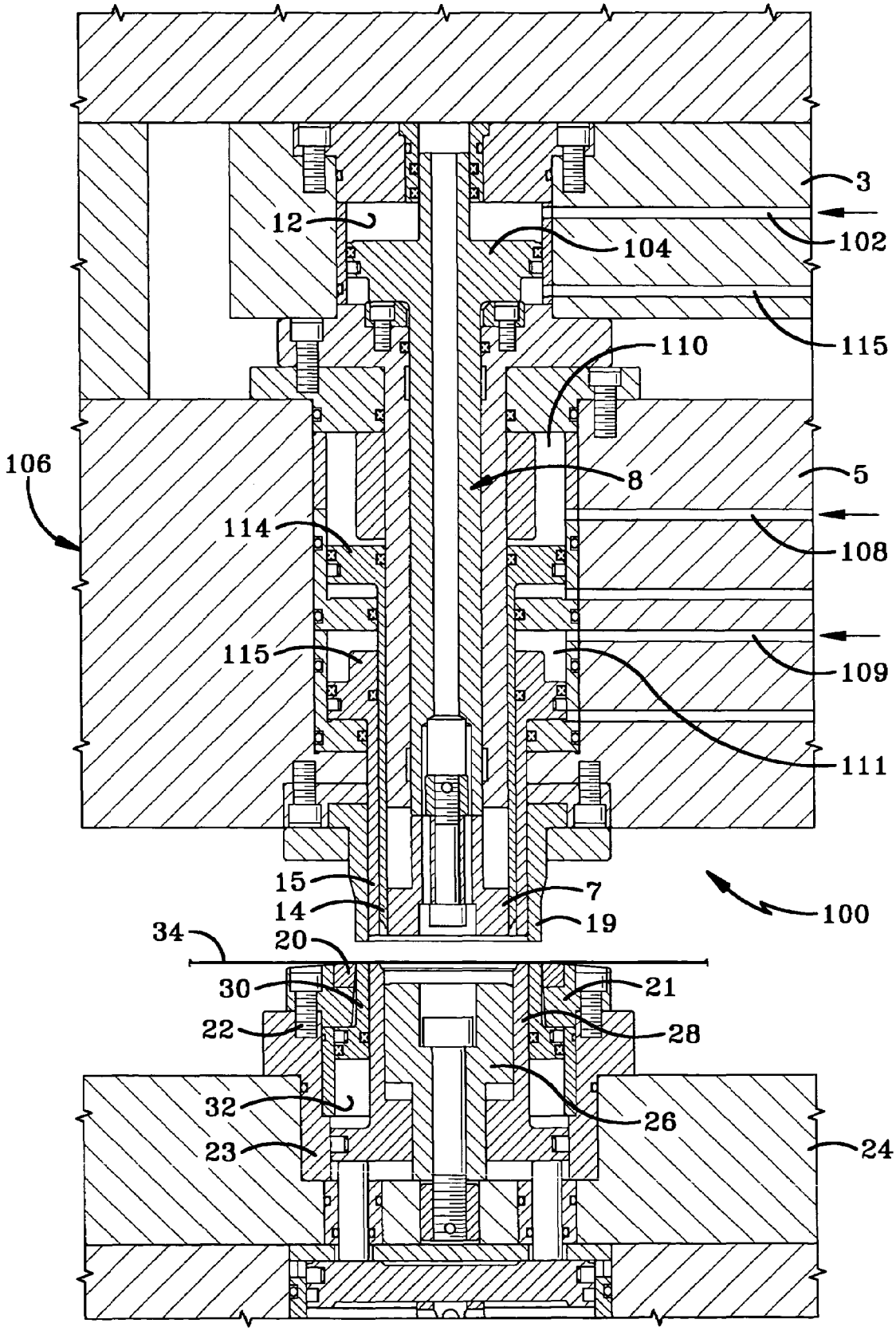
FIG. 9 is a partial schematic sectional view of a modified apparatus of the present invention showing a single action press and the position of the sheet metal and press components at the start of the shell forming operation.

FIG. 9 shows the position of the various press apparatus at the start of a cycle, and in particular, wherein a fluid pressure such as air, is supplied to cylinder 12 through air inlet line 102. This pressure forces punch core 7 in a downward position wherein an upper end 104 thereof functions as a piston within cylinder 12. FIG. 9 is very similar to the position of press 1 as shown in FIG. 1.

Figure 10:
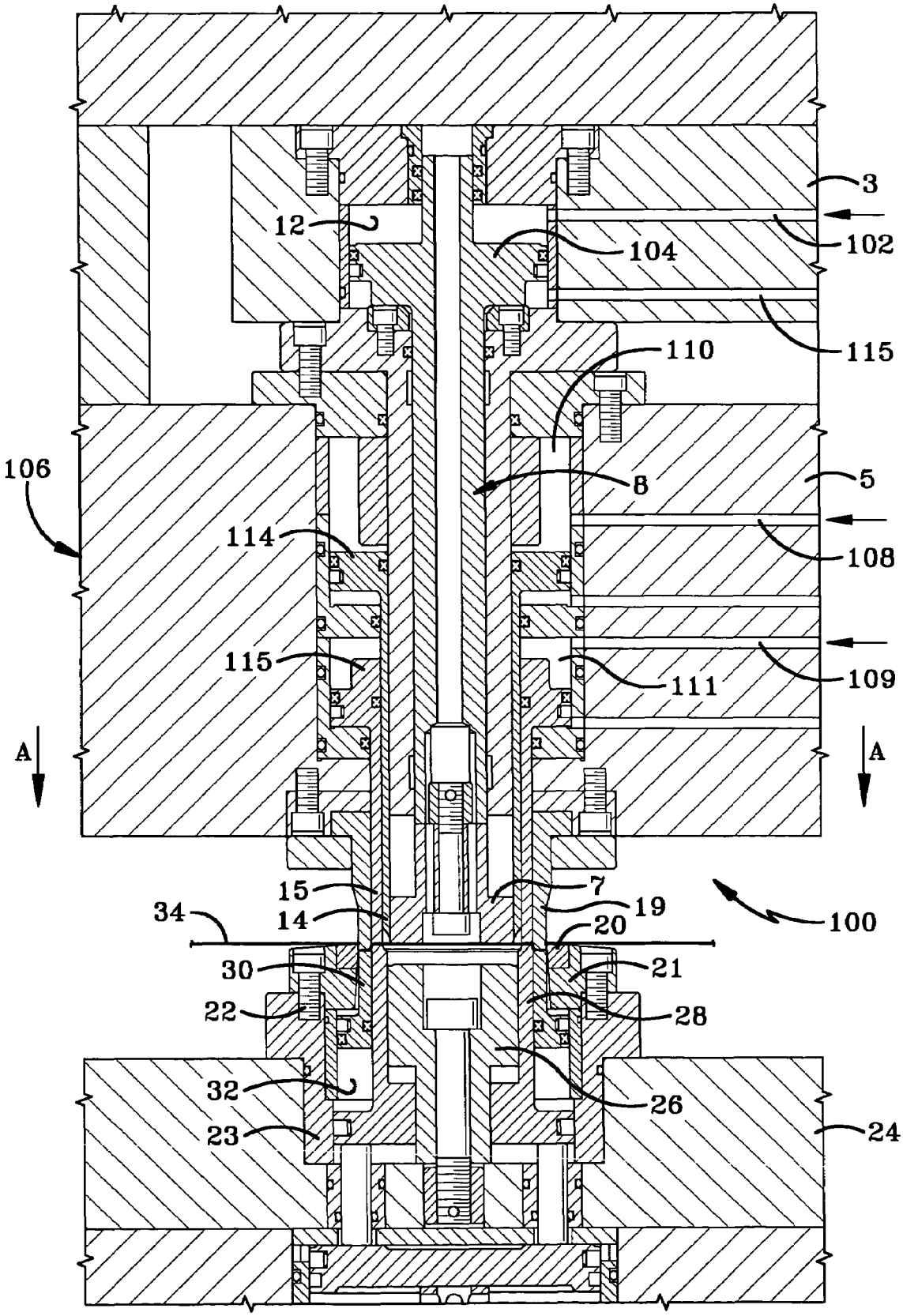
FIG. 10 is a view similar to FIG. 9 showing the blanking of a disk blank from the sheet metal at the start of the forming operation in a single action press.
Figure 11:
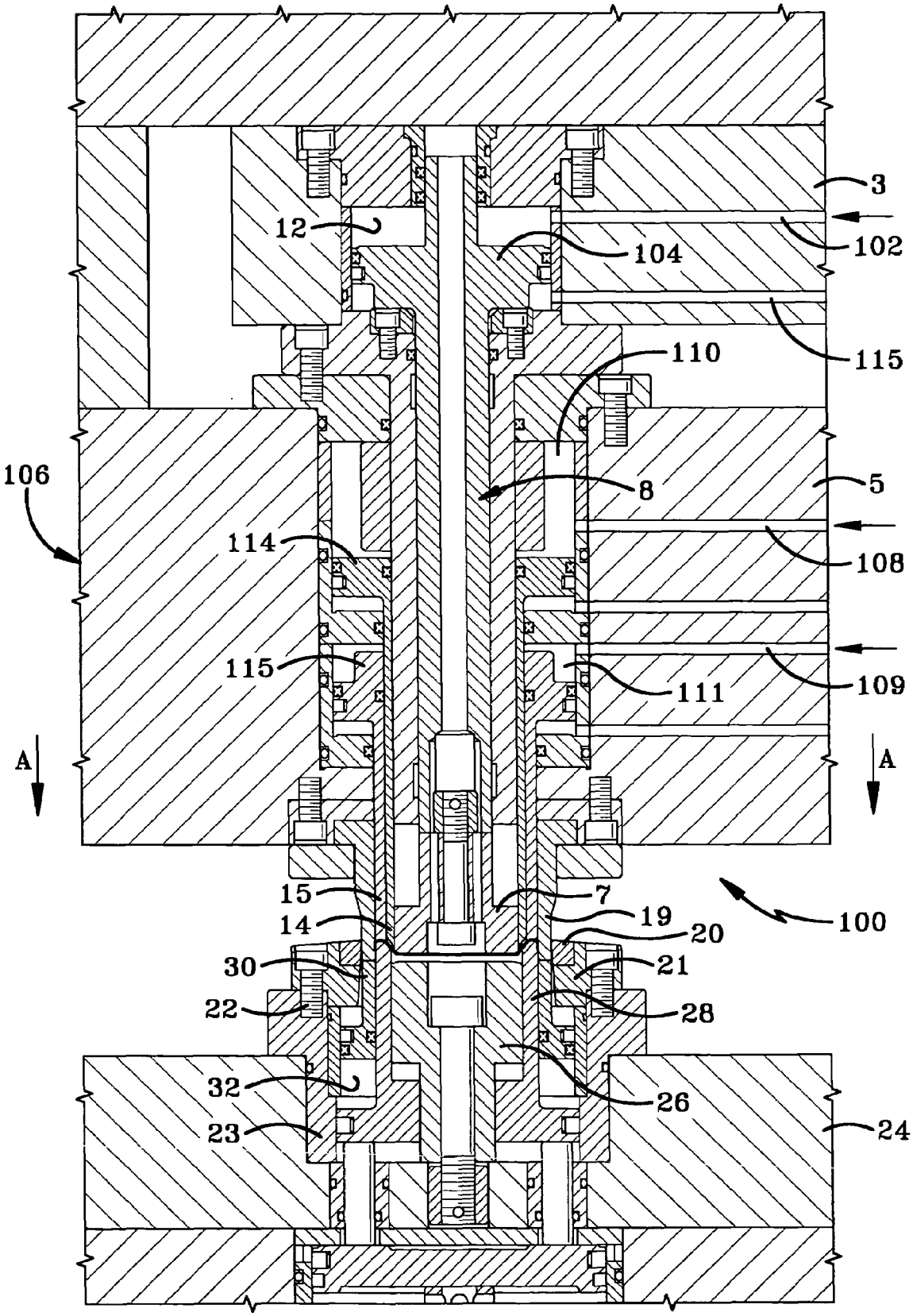
FIG. 11 is a view similar to FIG. 10 showing the single action press components at the start of forming the chuckwall of an end shell blank.
Figure 12:
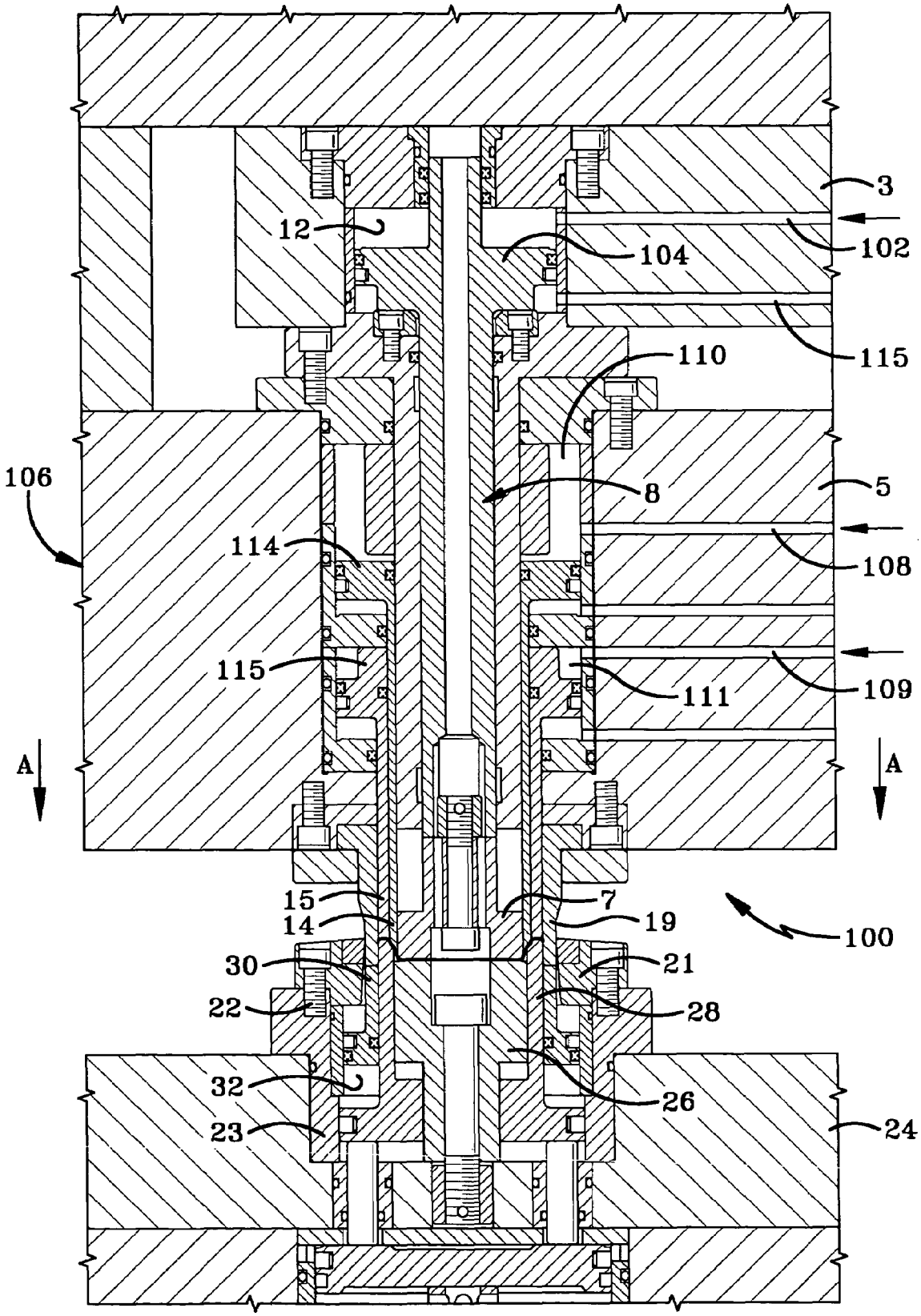
FIG. 12 is a view similar to FIG. 11 showing the punch core and inner pressure sleeve in clamping engagement with the end shell.
Figure 13:
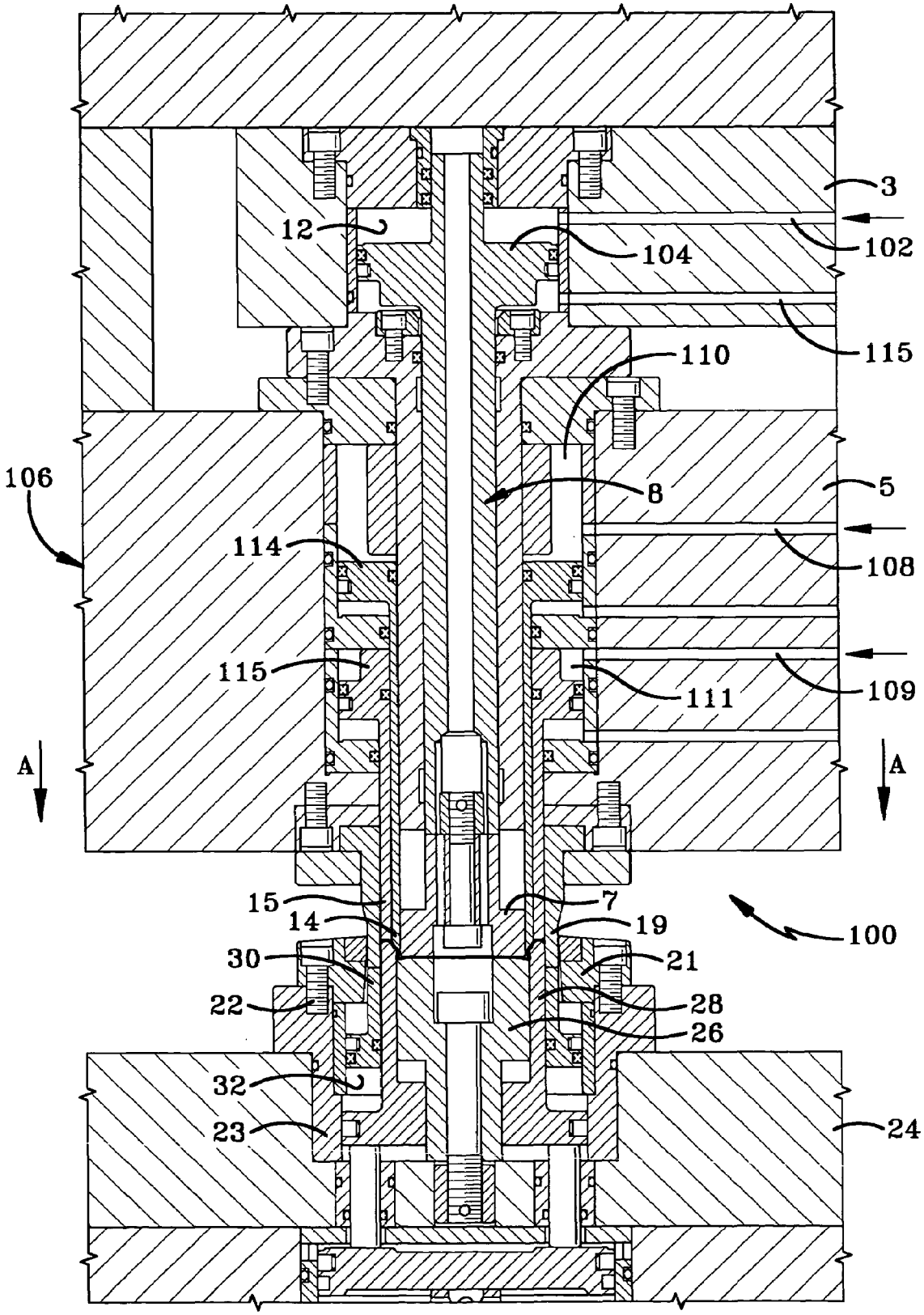
FIG. 13 is a view similar to FIG. 12 showing the continued downward movement of the inner and outer pressure sleeves to start the folding of the unclamped chuckwall portion of the end shell into the reinforcing rib.

FIG. 10 shows the movement of ram 106 as it moves downwardly in the direction of arrow A, which results in blank disk 36 being severed from strip material 34 by punch shell 19 and cut ring 20. Inner and outer pressure sleeves 14 and 15, punch core 7, and punch shell 19 move downwardly with ram 106 and assume the positions as shown in FIG. 3A. Inner and outer sleeves 14 and 15 are maintained in their position by supplying a pressurized fluid through lines 108 and 109 into their respective annular cylinders 110 and 111 for acting upon pistons 114 and 115, respectively. As ram 106 continues to move downwardly in the direction of Arrow A, FIG. 11, punch core 7, inner pressure sleeve 14, and outer punch shell 19 continue to move downwardly, maintaining their same relationship with ram 106 due to the pressure within the respective cylinders associated therewith. Outer pressure sleeve 15 will clamp outer flange 43 of the partially formed end shell against the top surface of die core ring 28 in a similar manner as shown in FIG. 3B.

Continued downward movement of ram 106 in the direction of arrows A (FIG. 12) will result in punch core 7 clamping end shell 40, and in particular central panel 41 thereof, against the top surface of die core 26 such as shown in FIG. 4A. Upon punch core 7 encountering fixed die core 26, ram 106 will continue to move downwardly by overcoming the air pressure within cylinder 12 as discussed above with respect to press 1. This downward movement of ram 106 will continue to move inner and outer pressure sleeves 14 and 15 and punch shell 19 downwardly as shown in FIG. 4A to the position shown in FIG. 13. This movement will form rolled reinforcing rib 60 within void 46 in the same manner as discussed above and shown in FIGS. 4A and 4B. Piston 104 and punch core 7 remain generally stationary, but piston 104 changes its position within cylinder 12 due to the continued downward movement of cylinder 12 with ram 106. Again, this provides dwell time for punch core 7 against central panel 41 of the shell as ram 106 continues its downward movement.

Figure 14:
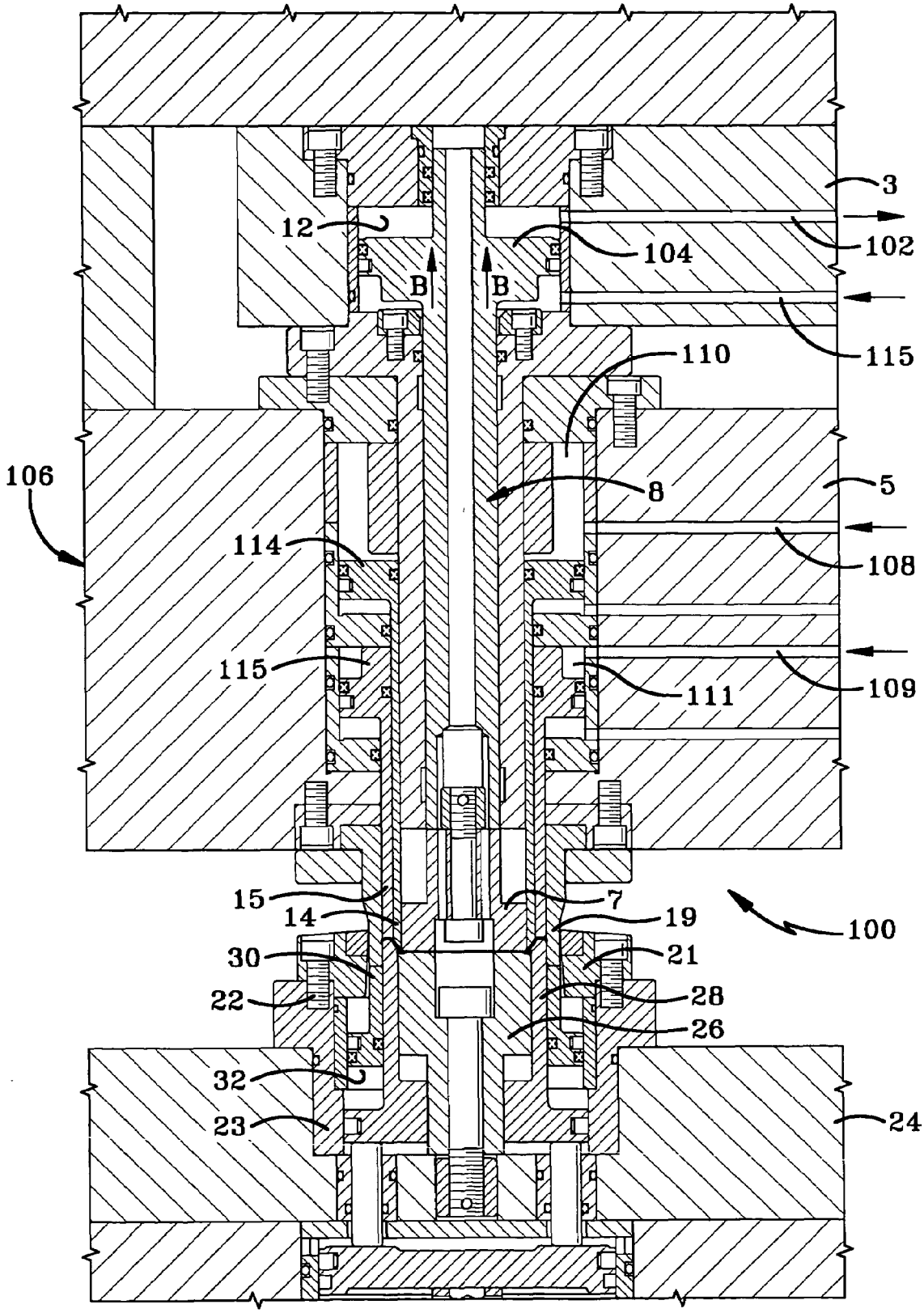
FIG. 14 is a view similar to FIG. 13 showing the position of the press components after forming the rolled reinforcing rib in the end shell.
Figure 15:
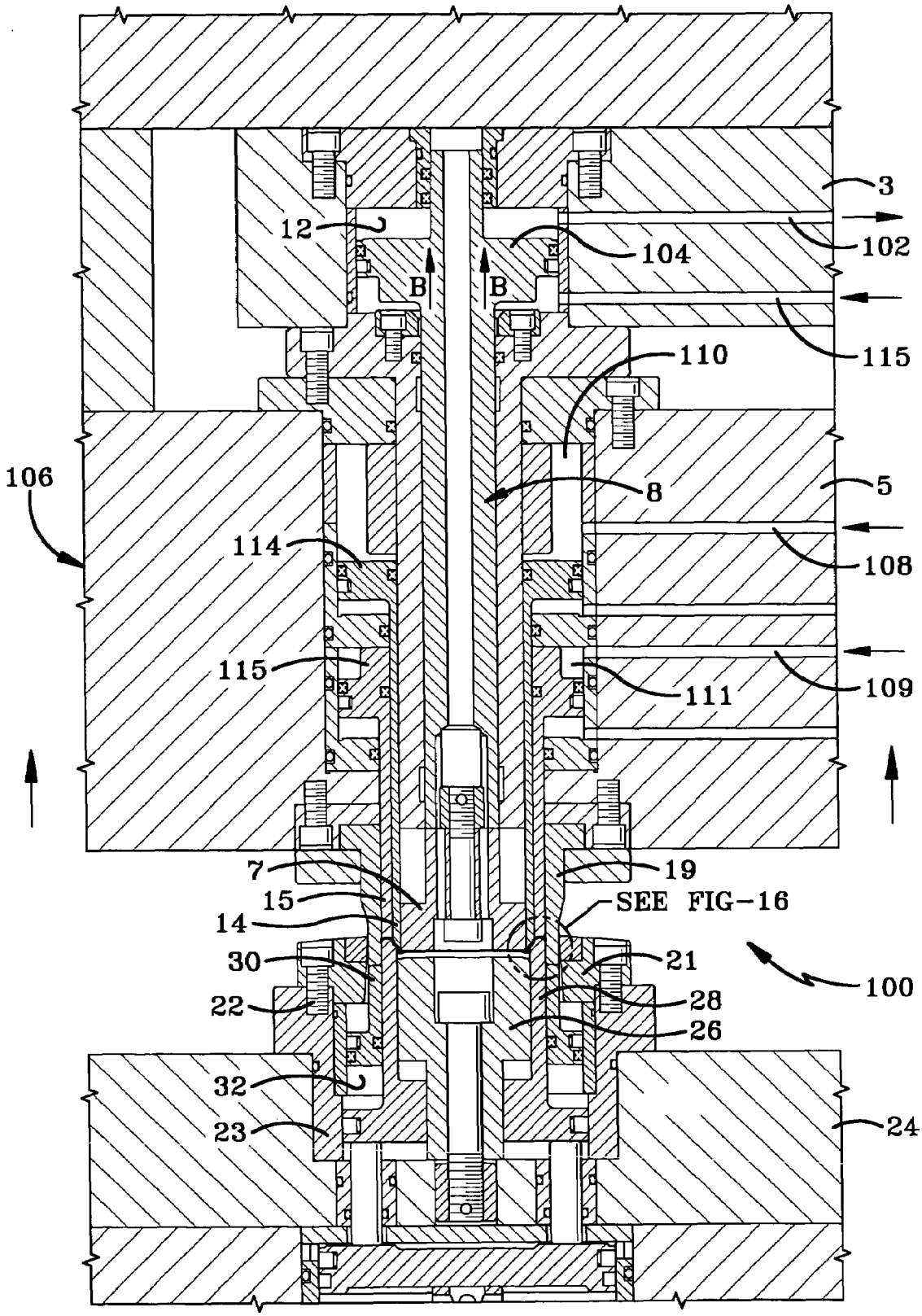
FIG. 15 is a view similar to FIG. 14 showing the movement of the punch core and inner and outer pressure sleeves toward a retracted position.
Figure 16:
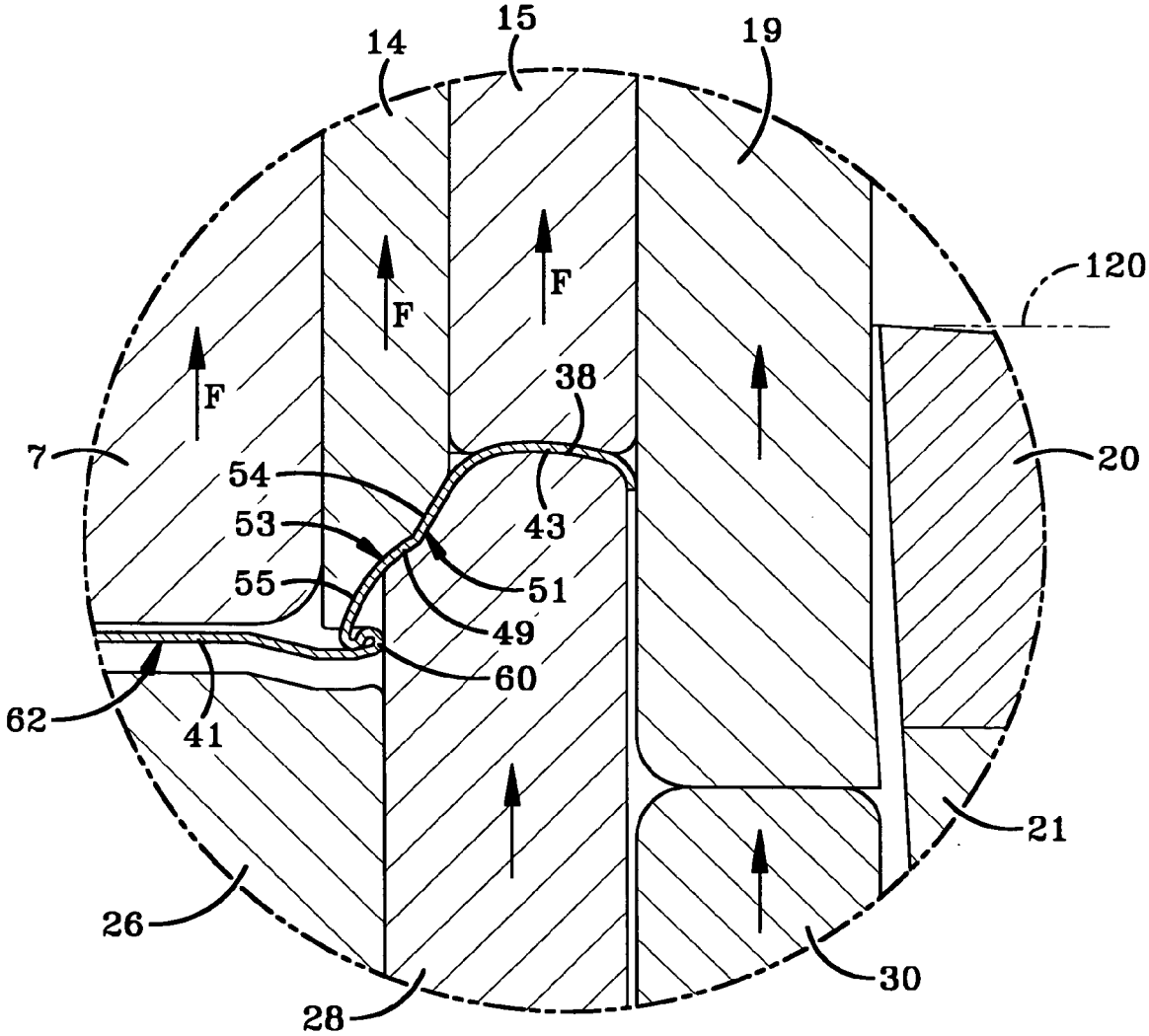
FIG. 16 is an enlarged fragmentary sectional view of the encircled portion of FIG. 15.
Figure 17:
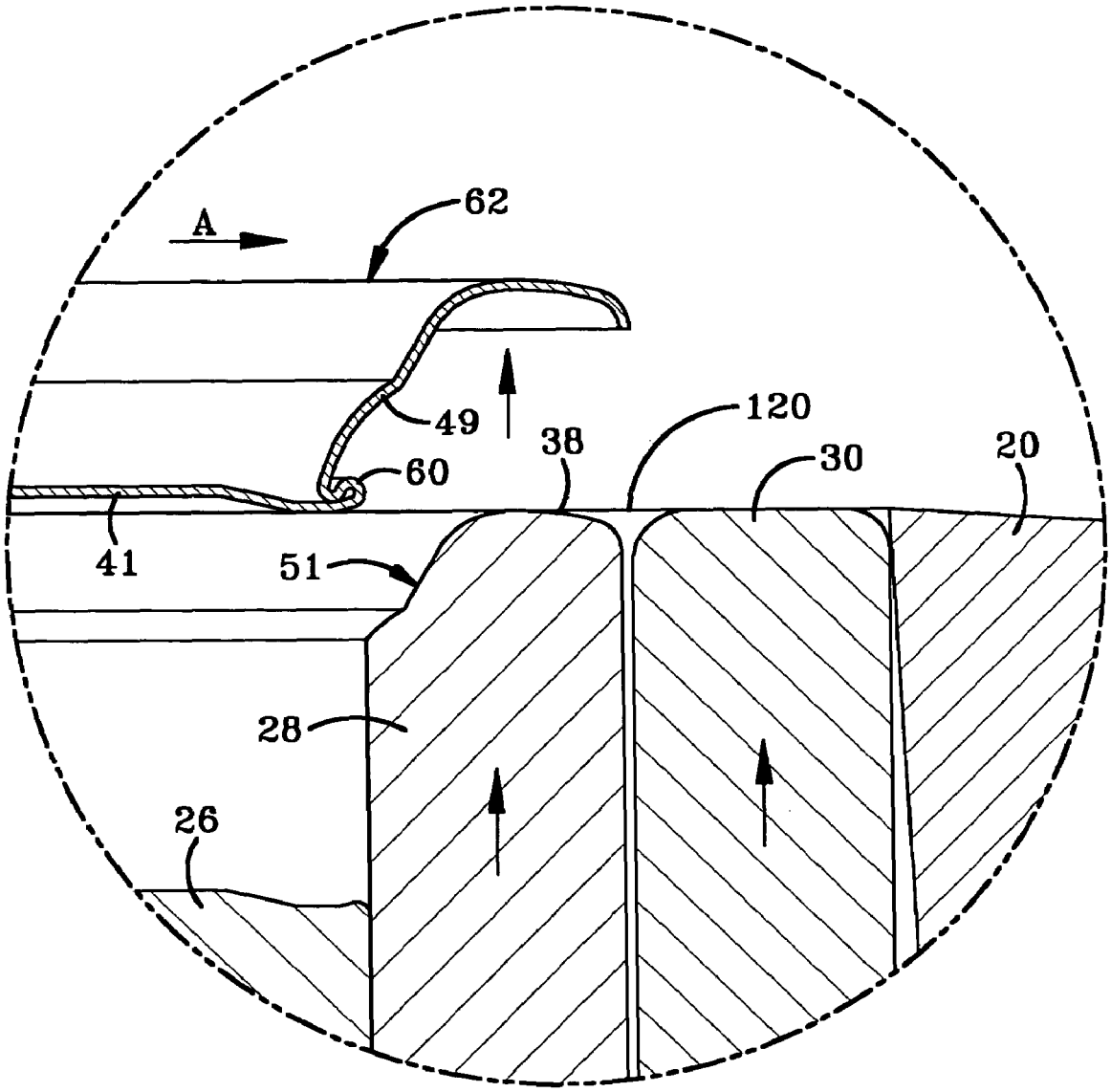
FIG. 17 is an enlarged fragmentary sectional view showing the end shell being ejected from the press.

Upon ram 106 reaching the bottom of its stroke as shown in FIG. 14 and in FIG. 5A, the pressurized air supplied to cylinder 12 through line 102 will reverse and enter the bottom of cylinder 12 through line 115. This incoming air acts upon piston 104 and correspondingly on punch riser 8 and punch core 7, to move them in an upward direction as shown by arrows B (FIG. 14). This action occurs either just prior to or simultaneously with the upward movement of inner and outer pressure sleeves 14 and 15 caused by the upward movement of ram 106. Upward movement of punch core 7 will release clamping pressure on finished end shell 62, and particularly on central panel 41 thereof as shown in FIG. 16. As discussed previously, this release of clamping pressure on the just formed end shell, and in particular, the release of clamping pressure exerted on panel 41 by punch core 7 will prevent rolled rib 60 from unrolling as heretofore occurred in prior art single press operations which maintained punch core 7 in clamping engagement with the central panel thereof and did not release this clamping force before the clamping pressure was released on the rolled rib area exerted by the inner and outer pressure sleeves. Ram 106 continues to move upwardly, bringing with it punch core 7, inner and outer pressure sleeves 14 and 15, and punch shell 19 due to the pressure maintained within the individual cylinders of these members by the pressurized air contained therein. Die core ring 28 will raise finished shell 62 upwardly until it reaches the discharge position, which is the cut line 120 where the blank disc is cut from the strip material, as shown in FIG. 17, wherein the finished shell is discharged by a blast of pressurized air, as shown by arrow A, or other ejection mechanism.

Again, it is the release of the clamping pressure of punch core 7 from central panel 41 of finished shell 62 as shown in FIG. 16, prior to or simultaneously with the release of the clamping pressure exerted on the chuckwall and flanged end of the shell by inner and outer pressure sleeves 14 and 15, which prevents the partial unrolling of the formed rib 60. Although FIG. 16 shows sleeves 14 and 15 and die core ring 28 still in engagement with the chuckwall and flanged area of the shell they are not exerting a strong clamping force thereon, since the shell is merely being raised upwardly by the fluid pressure acting on die core ring 28. The upward motion of ram 106 and the fluid pressure acting on the opposite sides of the pistons 114 and 115 located within the respective cylinders control movement of inner and outer pressure sleeves 14 and 15. Again, the double action effect of the pressurized air acting upon piston 104 of punch core 7, and in particular on punch riser 8, enables the timing of the upward movement of the punch core to release its clamping pressure just prior to or simultaneously with the ram beginning its upward movement which will release the clamping pressure exerted by pressure sleeves 14 and 15. Furthermore, the pressurized air acting on the top of piston 104 enables punch core 7 to maintain its clamping engagement with the central panel of the shell blank as the inner and outer pressure sleeve continue their downward movement to form reinforcing rib 60.

Thus, the improved method and apparatus of the present invention enables both single and double action presses to be easily modified to permit the forming of rolled reinforcing rib 60 in a single stroke and in a single press, avoiding any further manipulation of the end shell with respect to reinforcing rib 60, due to the release of clamping pressure exerted on the formed shell central panel by punch core 7, as shown in FIGS. 5A, 5B, 16, which release of pressure must occur simultaneously with, or just prior to, the release of clamping pressure exerted on the rolled rib and connected annular flange of the finished shell by inner and outer pressure sleeves 14 and 15.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of forming an annular rolled reinforcing rib between a central panel and a chuckwall of an end shell in a single stroke and at a single station of a single action press prior to the removal of the shell from the press, comprising the steps of:

blanking and drawing a disc blank having a central panel and a chuckwall terminating in an outer flange;

clamping a portion of the chuckwall between a pressure member and a die core ring;

forming the rolled reinforcing rib from an unclamped portion of the chuckwall located between the clamped portion and the central panel within an annular void formed between a punch core and the die core ring by advancing the pressure member while maintaining clamping engagement of the central panel between the punch core and a die core, and the portion of the chuckwall between the pressure member and die core ring; and releasing the clamping engagement on the central panel between the punch core and die core prior to or substantially simultaneously with the release of clamping engagement on the chuckwall between the pressure member and die core ring after forming the reinforcing rib.

2. The method defined in claim 1 including the steps of:

providing a ram;

mounting the punch core on the ram;

applying a fluid pressure in a first direction to the punch core for clamping the central panel of the disc blank between the punch core and die core; and continuing to advance the ram after the die core has clamped the central panel between the punch core and die core by overcoming said fluid pressure to provide a dwell time for said punch core in clamping engagement with said central panel.

3. The method defined in claim 2 including the step of applying a fluid pressure in a second direction to the punch core to release the clamping engagement of the central panel between the punch core and die core.

4. The method defined in claim 1 including the steps of: applying a fluid pressure to the pressure member for clamping the portion of the chuckwall between the pressure member and the die core ring before forming the rolled reinforcing rib.

5. The method defined in claim 1 including the step of mounting the die core in a fixed position on a base.

6. The method defined in claim 1 including the step of providing the pressure member with a contoured end having an angled surface portion and a concave surface portion.

7. The method defined in claim 1 including the step of blanking the disc blank from a sheet of strip material at a cut line level; raising the end shell to the cut line level; and ejecting the end shell from the press at the cut line level with pressurized air.

8. The method defined in claim 1 including the step of blanking the disc blank from a strip of sheet material; and forming the chuckwall by advancing the punch core and clamping an outer portion of the disc blank between the pressure member and die core ring.

9. The method defined in claim 1 including the step of forming the annual void when the punch core clamps the central panel against the die core.

10. The method defined in claim 1 including the step of forming the pressure member of inner and outer pressure sleeves and providing each of said sleeves with a fluid pressure cylinder to provide for independent movement of said sleeves.

11. The method of claim 10 under the steps of providing the inner pressure sleeve with a concave surface and the outer sleeve with surface complementary to an upper clamping surface of the die core ring.

12. Apparatus for forming a container end panel having a central panel, an outer flange and chuckwall, and a rolled reinforcement rib interconnecting said chuckwall and central panel, comprising:

a moveable ram;

a punch core mounted on the ram;

a pressure member disposed in concentric relationship about said punch core and moveable by the ram;

a die core mounted on a base and disposed in opposed relationship with said punch core;

a movable die core ring mounted on the base and disposed in opposed relationship with said pressure member; and a two-way fluid actuated piston mounted on the ram for controlling movement of the punch core independent of the movement of the ram, enabling the ram to continue moving said pressure member with respect to said punch core after said punch core has reached a bottom-dead-center position.

13. The apparatus defined in claim 12 wherein the die core ring is radially spaced from the punch core upon said punch core extending into clamping engagement with said die core to form an annular void therebetween.

14. The apparatus defined in claim 12 wherein the pressure member is a pair of concentric inner and outer pressure sleeves.

15. The apparatus defined in claim 14 wherein the die core ring has a profiled end with a curved outer end surface and an angled adjoining surface; in which the outer pressure ring has an end surface complementary to said curved surface of the die core ring and is in opposed relationship therewith; and in which the inner pressure sleeve has an angled end surface complementary to and in opposed relationship to the angled surface of said die core ring.

16. The apparatus defined in claim 14 wherein the inner pressure sleeve has a curved concave surface adjacent the angled surface thereof; and in which said curved surface extends into a spaced formed between the punch core and die core ring.

17. The apparatus defined in claim 12 including fluid pressure lines communicating with a fluid pressure cylinder containing the piston for selectively moving the piston within the cylinder in first and second directions.

18. In a single action press having a ram and an opposed base and apparatus for forming an end shell of a container from a sheet metal blank, wherein the end shell has a rolled annular reinforcing rib, said apparatus comprising:

a) a punch core carried by the ram and a die core mounted on the base in opposed relationship therewith;

b) a fluid operated piston mounted on said ram for controlling movement of the punch core independently of the ram;

c) inner and outer pressure sleeves carried by said ram and a movable die core ring carried by the base in opposed relationship therewith;

d) the outer pressure sleeve releasably holding an outer flange of the blank against the die core ring as the die core draws material over the die core ring to form a chuckwall extending between said outer flange and a central panel;

e) the inner pressure sleeve being movable into clamping engagement with and holding a portion of the chuckwall adjacent the outer flange against the die core ring leaving an unclamped portion of the chuckwall extending between the central panel and clamped portion of said chuckwall;

f) the inner and outer pressure sleeves being movable toward the base while maintaining clamping engagement of the chuckwall and the outer flange against the die core ring to roll the unclamped portion of the chuckwall into the rolled reinforcing rib; and g) the punch core being moved out of clamping engagement with the central panel prior or simultaneously with the inner and outer pressure sleeves moving out of clamping engagement with the chuckwall to retain the shape of the rolled reinforcing rib.

19. The apparatus defined in claim 18 including a punch shell carried by the ram and a pressure supported sleeve mounted on the base in opposed relationship to said punch shell.

20. The apparatus defined in claim 18 including a fluid pressure cylinder mounted on the ram; and a fluid actuated piston located within the cylinder and operatively connected to the punch core for controlling movement of the punch core independently of the ram.

21. The apparatus defined in claim 18 including a pair of fluid pressure lines communicating with the piston for selectively applying fluid pressure to the piston for moving the punch core in first and second directions for applying and releasing clamping pressure on the central panel of the end shell.

22. The apparatus defined in claim 18 wherein the inner pressure sleeve and die core ring have complementary shaped clamping surface for holding the portion of the chuckwall therebetween.

* * * * *